US007607317B2

(12) United States Patent
Honda et al.

(10) Patent No.: US 7,607,317 B2
(45) Date of Patent: Oct. 27, 2009

(54) AIR CONDITIONER WITH OIL RECOVERY FUNCTION

(75) Inventors: Masahiro Honda, Sakai (JP); Yasushi Hori, Sakai (JP); Shigeaki Umeyama, Sakai (JP); Keiji Ishida, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 415 days.

(21) Appl. No.: 10/586,582

(22) PCT Filed: Jul. 28, 2005

(86) PCT No.: PCT/JP2005/013814

§ 371 (c)(1),
(2), (4) Date: Jul. 19, 2006

(87) PCT Pub. No.: WO2006/013769

PCT Pub. Date: Feb. 9, 2006

(65) Prior Publication Data

US 2008/0236189 A1 Oct. 2, 2008

(30) Foreign Application Priority Data

Aug. 4, 2004 (JP) ..... 2004-227662

(51) Int. Cl.
*F25B 15/00* (2006.01)

(52) U.S. Cl. ..... 62/324.1; 62/160; 62/174

(58) Field of Classification Search ..... 62/324.1, 62/324.2, 324.6, 159, 160, 84, 192, 468, 62/196.3, 200

See application file for complete search history.

(56) References Cited

U.S. PATENT DOCUMENTS 4,715,196 A 12/1987 Sugiura
5,009,077 A * 4/1991 Okoshi et al. ..... 62/160
5,046,323 A * 9/1991 Kuwahara ..... 62/140

(Continued)

FOREIGN PATENT DOCUMENTS

GB 2 235 790 A 3/1991

(Continued)

OTHER PUBLICATIONS

Grimm, Nils R. et al, HVAC Systems and Components Handbook, 1990, Mc Graw-Hill, Second edition, pp. 5.10.10.*

(Continued)

*Primary Examiner*—Frantz F Jules
*Assistant Examiner*—Cassey Bauer
(74) *Attorney, Agent, or Firm*—Global IP Counselors, LLP

(57) ABSTRACT

An air conditioner includes a refrigerant circuit that includes a heat source heat exchanger configured such that refrigerant flows in from below and flows out from above when the heat source heat exchanger functions as an evaporator of the refrigerant and a plurality of utilization heat exchangers. When the heat source heat exchanger is caused to function as an evaporator, the refrigerant discharged from a compression mechanism is bypassed to an intake side of the compression mechanism via a first bypass circuit, the heat source heat exchanger is caused to function as a condenser, and an expansion valve is closed, whereby refrigerating machine oil accumulating inside the heat source heat exchanger is returned to the intake side of the compression mechanism from a lower portion of the heat source heat exchanger via an oil returning circuit.

20 Claims, 12 Drawing Sheets

U.S. PATENT DOCUMENTS

| | | | | |
|---|---|---|---|---|
| 5,526,649 | A * | 6/1996 | Sada | 62/175 |
| 2003/0230096 | A1* | 12/2003 | Hwang | 62/160 |
| 2004/0035132 | A1* | 2/2004 | Park et al. | 62/324.1 |
| 2004/0134215 | A1* | 7/2004 | Park et al. | 62/324.1 |

FOREIGN PATENT DOCUMENTS

| | | | |
|---|---|---|---|
| JP | 62-57038 | U | 4/1987 |
| JP | 62-276368 | A | 12/1987 |
| JP | 63-204074 | A | 8/1988 |
| JP | 03-036474 | A | 2/1991 |
| JP | 03-129259 | A | 6/1991 |
| JP | 03-260561 | A | 11/1991 |
| JP | 04-074257 | U | 6/1992 |
| JP | 2003-240364 | A | 2/2002 |
| JP | 2003-287291 | A | 10/2003 |

OTHER PUBLICATIONS

Wang, Shan K., Handbook of Air Conditioning and Refrigeration, 1993, Mc Graw-Hill, Second edition, pp. 28.24 through 28.30.*

* cited by examiner

AIR CONDITIONER WITH OIL RECOVERY FUNCTION

CROSS-REFERENCE TO RELATED APPLICATIONS

This U.S. National stage application claims priority under 35 U.S.C. §119(a) to Japanese Patent Application No. 2004-227662, filed in Japan on Aug. 4, 2004, the entire contents of which are hereby incorporated herein by reference.

TECHNICAL FIELD

The present invention relates to an air conditioner, and in particular to an air conditioner disposed with a refrigerant circuit that includes a heat source heat exchanger configured such that refrigerant flows in from below and flows out from above when the heat source heat exchanger functions as an evaporator of refrigerant, with the refrigerant circuit being capable of switching that causes the heat source heat exchanger and utilization heat exchangers to function separately as evaporators or condensers of the refrigerant.

BACKGROUND ART

Conventionally, there has been a refrigerating apparatus disposed with a vapor compression-type refrigerant circuit including a heat exchanger configured such that refrigerant flows in from below and flows out from above as an evaporator of the refrigerant (e.g., see Japanese Patent Application Publication No. S63-204074). In order to prevent refrigerating machine oil from accumulating inside the evaporator, the refrigerating apparatus is configured to extract, from the vicinity of the surface of the refrigerant, the refrigerating machine oil accumulating in a state where it floats on the surface of the refrigerant as a result of the refrigerating machine oil and the refrigerant separating into two layers because the specific gravity of the refrigerating machine oil is smaller than that of the refrigerant, and to return the refrigerating machine oil to the intake side of the compressor.

Further, as an example of a refrigerating apparatus disposed with a vapor compression-type refrigerant circuit, there is an air conditioner that is capable of a simultaneous cooling and heating operation and is disposed with a vapor compression-type refrigerant circuit capable of switching that causes heat source heat exchangers and utilization heat exchangers to function separately as evaporators or condensers of the refrigerant (e.g., see Japanese Patent Application Publication No. H03-260561). In this air conditioner, plural heat source heat exchangers are disposed, and expansion valves are disposed such that they can regulate the flow rate of the refrigerant flowing into the heat source heat exchangers. Additionally, in this air conditioner, when the heat source heat exchangers are caused to function as evaporators during a heating operation or during the simultaneous cooling and heating operation, for example, control is conducted to reduce the evaporating ability by reducing the openings of the expansion valves as the air conditioning load of the utilization heat exchangers becomes smaller. Moreover, when the air conditioning load of the utilization heat exchangers becomes extremely small, control is conducted to reduce the evaporating ability by closing some of the plural expansion valves to reduce the number of heat source heat exchangers functioning as evaporators or to reduce the evaporating ability by causing some of the plural heat source heat exchangers to function as condensers to offset the evaporating ability of the heat source heat exchangers functioning as evaporators.

Further, in the aforementioned air conditioner, when the heat source heat exchangers are caused to function as condensers during a cooling operation or during the simultaneous cooling and heating operation, for example, control is conducted to reduce the condensing ability by increasing the amount of liquid refrigerant accumulating inside the heat source heat exchangers and reducing the substantial heat transfer area by reducing the openings of the expansion valves connected to the heat source heat exchangers as the air conditioning load of the utilization heat exchangers becomes smaller. However, when control is conducted to reduce the openings of the expansion valves, there has been the problem that there is a tendency for the refrigerant pressure downstream of the expansion valves (specifically, between the expansion valves and the utilization heat exchangers) to drop and become unstable, and control to reduce the condensing ability of the heat source heat exchangers cannot be stably conducted. In order to counter this problem, control has been proposed to raise the refrigerant pressure downstream of the expansion valves by disposing a pressurizing circuit that causes high-pressure gas refrigerant compressed by the compressor to merge with refrigerant whose pressure has been reduced in the expansion valves and is sent to the utilization heat exchangers (e.g., see Japanese Patent Application Publication No. H03-129259).

SUMMARY OF THE INVENTION

In the aforementioned air conditioners, there are cases where a heat exchanger such as a plate heat exchanger configured such that the refrigerant flows in from below and flows out from above when the heat exchangers function as evaporators of the refrigerant is used as the heat source heat exchangers. In these cases, in order to prevent the refrigerating machine oil from accumulating inside the heat source heat exchangers, it is necessary to maintain the level of the refrigerant inside the heat source heat exchangers at a constant level or more. However, even if one tries to reduce the amount of refrigerant flowing through the heat source heat exchangers by reducing the openings of the expansion valves when the heat source heat exchangers are caused to function as evaporators with little evaporating ability, such as when the air conditioning load in the utilization heat exchangers becomes extremely small, the evaporating ability cannot be sufficiently controlled just by regulating the openings of the expansion valves because the openings of the expansion valves cannot be reduced that much due to the restriction of the level of the refrigerant inside the heat source heat exchangers. As a result, it becomes necessary to conduct control to reduce the evaporating ability by closing some of the plural expansion valves to reduce the number of heat source heat exchangers functioning as evaporators or to reduce the evaporating ability by causing some of the plural heat source heat exchangers to function as condensers to offset the evaporating ability of the heat source heat exchangers functioning as evaporators.

For this reason, there are the problems that increases in the number of parts and cost arise as a result of disposing plural heat source heat exchangers, the amount of the refrigerant compressed in the compressor increases in correspondence to the amount of refrigerant condensed by the heat source heat exchangers when some of the plural heat source heat exchangers are caused to function as condensers to reduce the evaporating ability, and the COP becomes poor in an operating condition where the air conditioning load of the utilization heat exchangers is small. In order to counter this problem, it is conceivable to conduct an operation (oil recovery operation) that prevents the refrigerating machine oil from accumulating in the heat source heat exchangers by temporarily switching to cause the heat source heat exchangers to function as condensers and ensuring that the refrigerant flows from the upper sides of the heat source heat exchangers to the lower sides in order to ensure that the heat source heat exchangers can be caused to function as evaporators with small evaporating ability while allowing a drop in the level, without disposing a heat source heat exchanger for offsetting the evaporating ability. However, there is the potential for indoor comfort to be compromised because the utilization heat exchangers in the middle of the heating operation (i.e., functioning as condensers) must be temporarily switched to the cooling operation (i.e., functioning as evaporators).

Further, in the aforementioned air conditioners, when a pressurizing circuit is disposed in the refrigerant circuit to cause the high-pressure gas refrigerant compressed by the compressor to merge with the refrigerant whose pressure has been reduced in the expansion valves and which is sent to the utilization heat exchangers when the heat source heat exchangers are caused to function as condensers of the refrigerant, the refrigerant sent from the expansion valve to the utilization heat exchangers becomes a gas-liquid two-phase flow. Moreover, the gas fraction of the refrigerant after the high-pressure gas refrigerant has merged therewith from the pressurizing circuit becomes larger the more the openings of the expansion valves are reduced, and drift arises between the plural utilization heat exchangers, resulting in the problem that the openings of the expansion valves cannot be sufficiently reduced. As a result, similar to when the heat source heat exchangers are caused to function as evaporators of the refrigerant, when plural heat source heat exchangers are disposed and the air conditioning load of the utilization heat exchangers becomes extremely small, it becomes necessary to conduct control to reduce the condensing ability by closing the plural expansion valves to reduce the number of heat source heat exchangers functioning as evaporators or to reduce the condensing ability by causing some of the plural heat source heat exchangers to function as evaporators to offset the condensing ability of the heat source heat exchangers functioning as condensers.

For this reason, there are the problems that increases in the number of parts and cost arise as a result of disposing plural heat source heat exchangers, the amount of the refrigerant compressed in the compressor increases in correspondence to the amount of refrigerant evaporated by the heat source heat exchangers when some of the plural heat source heat exchangers are caused to function as evaporators to reduce the condensing ability, and the COP becomes poor in an operating condition where the air conditioning load of the utilization heat exchangers is small.

It is an object of the present invention to expand, in an air conditioner disposed with a refrigerant circuit that includes a heat source heat exchanger configured such that refrigerant flows in from below and flows out from above when the heat source heat exchanger functions as an evaporator of refrigerant and with the refrigerant circuit being capable of switching that causes the heat source heat exchanger and utilization heat exchangers to function separately as evaporators or condensers of refrigerant, the control width when the condensing ability of the heat source heat exchanger is controlled by an expansion valve.

An air conditioner pertaining to a first aspect of the present invention is disposed with a refrigerant circuit, a first bypass circuit, and an oil returning circuit. The refrigerant circuit includes a compressor, a heat source heat exchanger configured such that refrigerant flows in from below and flows out from above when the heat source heat exchanger functions as an evaporator of the refrigerant, utilization heat exchangers, a liquid refrigerant pipe that connects the heat source heat exchanger and the utilization heat exchangers, and an expansion valve disposed in the liquid refrigerant pipe, with the refrigerant circuit being capable of switching to cause the heat source heat exchanger and the utilization heat exchangers to function separately as evaporators or condensers of the refrigerant. The first bypass circuit can bypass the refrigerant discharged from the compression mechanism to an intake side of the compression mechanism. The oil returning circuit connects a lower portion of the heat source heat exchanger and the intake side of the compression mechanism. Additionally, the air conditioner conducts an oil recovery operation where, when the heat source heat exchanger is caused to function and operates as an evaporator, the refrigerant discharged from the compression mechanism is bypassed to the intake side of the compression mechanism via the first bypass circuit, operation is switched to an operation causing the heat source heat exchanger to function as a condenser, and the expansion valve is closed, whereby the refrigerant discharged from the compression mechanism is caused to flow into the heat source heat exchanger, and refrigerating machine oil accumulating inside the heat source heat exchanger is returned to the intake side of the compression mechanism via the oil returning circuit.

In this air conditioner, when an operation that causes the heat source heat exchanger to function as a condenser of the refrigerant is conducted, such as when a cooling operation or the like is conducted, the refrigerant discharged from the compression mechanism is condensed in the heat source heat exchanger, passes through the expansion valve, and is sent to the utilization heat exchangers. The refrigerant is taken into the compression mechanism after being evaporated in the utilization heat exchangers. Further, when an operation that causes the heat source heat exchanger to function as an evaporator of the refrigerant is conducted, such as when a heating operation or the like is conducted, the refrigerant discharged from the compression mechanism is condensed in the heat source heat exchanger, passes through the expansion valve, and is sent to the utilization heat exchangers. The refrigerant is taken into the compression mechanism after being evaporated in the heat source heat exchanger. Here, when the operation that causes the heat source heat exchanger to function as an evaporator is conducted, the refrigerant flows inside the heat source heat exchanger such that the refrigerant flows in from below and flows out from above. For this reason, when control is conducted to reduce the evaporating ability of the heat source heat exchanger by reducing the opening of the expansion valve in accordance with the air conditioning load in the utilization heat exchangers, refrigerating machine oil accumulates inside the heat source heat exchanger.

However, this air conditioner conducts the oil recovery operation where, when the heat source heat exchanger is caused to function and operates as an evaporator, the refrigerant discharged from the compression mechanism is bypassed to the intake side of the compression mechanism via the first bypass circuit, operation is switched to an operation causing the heat source heat exchanger to function as a condenser, and the expansion valve is closed, whereby the refrigerant discharged from the compression mechanism is caused to flow into the heat source heat exchanger, and refrigerating machine oil accumulating inside the heat source heat exchanger is returned to the intake side of the compression mechanism via the oil returning circuit. By conducting this oil recovery operation, the utilization heat exchangers are switched to evaporators and the orientation of the flow of the refrigerant in the entire refrigerant circuit does not have to be changed despite the fact that switching that causes the heat source heat exchanger to function as a condenser is conducted, so that the start of returning to the operating state prior to the oil recovery operation after the oil recovery operation can be quickly conducted, the indoor comfort is not compromised, and the refrigerating machine oil accumulating inside the heat source heat exchanger can be recovered in a short amount of time.

In this manner, in this air conditioner, even when control is conducted to reduce the evaporating ability of the heat source heat exchanger by reducing the opening of the expansion valve in accordance with the air conditioning load of the utilization heat exchangers so that as a result the level of the refrigerant inside the heat source heat exchanger drops, the refrigerating machine oil does not accumulate inside the heat source heat exchanger. For this reason, the control width when the evaporating ability of the heat source heat exchanger is controlled by the expansion valve can be expanded.

Additionally, in this air conditioner, it becomes unnecessary, unlike conventional air conditioners, to dispose plural heat source heat exchangers and conduct control to reduce the evaporating ability by closing some of the plural heat source expansion valves to reduce the number of heat source heat exchangers functioning as evaporators when the heat source heat exchangers are caused to function as evaporators or to reduce the evaporating ability by causing some of the heat source heat exchangers to function as condensers to offset the evaporating ability of the heat source heat exchangers functioning as evaporators. For this reason, a wide control width of the evaporating ability can be obtained by a single heat source heat exchanger.

Thus, because simplification of the heat source heat exchanger becomes possible in an air conditioner where simplification of the heat source heat exchangers could not be realized by restricting the control width of the control of the evaporating ability of the heat source heat exchangers, increases in the number of parts and cost that had occurred in conventional air conditioners as a result of disposing plural heat source heat exchangers can be prevented. Further, the problem of the COP becoming poor in an operating condition where, when some of plural heat source heat exchangers are caused to function as condensers to reduce the evaporating ability, the amount of refrigerant compressed in the compression mechanism increases in correspondence to the amount of refrigerant condensed by the heat source heat exchangers and the air conditioning load of the utilization refrigerant circuits is small can be eliminated.

An air conditioner pertaining to a second aspect of the present invention is disposed with a refrigerant circuit, a first bypass circuit, and an oil returning circuit. The refrigerant circuit includes a compressor, a heat source heat exchanger configured such that refrigerant flows in from below and flows out from above when the heat source heat exchanger functions as an evaporator of the refrigerant, utilization heat exchangers, a liquid refrigerant pipe that connects the heat source heat exchanger and the utilization heat exchangers, an expansion valve disposed in the liquid refrigerant pipe, a heat source switch mechanism that is capable of switching between a condensation operation switched state that causes the heat source heat exchanger to function as a condenser of the refrigerant discharged from the compression mechanism and an evaporation operation switched state that causes the heat source heat exchanger to function as an evaporator of the refrigerant flowing through the liquid refrigerant pipe, a high-pressure gas refrigerant pipe that is connected between an intake side of the compression mechanism and the heat source switch mechanism and can branch the refrigerant discharged from the compression mechanism before the refrigerant flows into the heat source switch mechanism, utilization switch mechanisms that are capable of switching between a cooling operation switched state that causes the heat source heat exchanger to function as an evaporator of the refrigerant flowing through the liquid refrigerant pipe and a heating operation switched state that causes the heat source heat exchanger to function as a condenser of the refrigerant flowing through the high-pressure gas refrigerant pipe, and a low-pressure gas refrigerant pipe that sends the refrigerant evaporated in the utilization heat exchangers to the intake side of the compression mechanism. The first bypass circuit can bypass the refrigerant discharged from the compression mechanism to the intake side of the compression mechanism. The oil returning circuit connects a lower portion of the heat source heat exchanger and the intake side of the compression mechanism. Additionally, the air conditioner conducts an oil recovery operation where, when the heat source switch mechanism is caused to function and operates as an evaporator, the refrigerant discharged from the compression mechanism is bypassed to the intake side of the compression mechanism via the first bypass circuit, the heat source switch mechanism is switched to the condensation operation state, and the expansion valve is closed, whereby the refrigerant discharged from the compression mechanism is caused to flow into the heat source heat exchanger, and refrigerating machine oil accumulating inside the heat source heat exchanger is returned to the intake side of the compression mechanism via the oil returning circuit.

In this air conditioner, when an operation that causes the heat source heat exchanger to function as a condenser of the refrigerant is conducted as a result of the heat source switch mechanism being switched to a condensation operation switched state, such as when a cooling operation or the like is conducted, the refrigerant discharged from the compression mechanism is sent to the heat source heat exchanger and condensed in the heat source heat exchanger. Then, the refrigerant is sent to the utilization heat exchangers through the liquid refrigerant pipe after passing through the expansion valve. Then, the refrigerant is evaporated in the utilization heat exchangers functioning as evaporators of the refrigerant as a result of the utilization switch mechanisms being switched to a cooling operation switched state, and is thereafter taken into the compression mechanism through the low-pressure gas refrigerant pipe. Further, when an operation that causes the heat source heat exchanger to function as an evaporator of the refrigerant is conducted as a result of the heat source switch mechanism being switched to the evaporation operation switched state, such as when a heating operation or the like is conducted, the refrigerant discharged from the compression mechanism passes through the high-pressure gas refrigerant pipe, is sent to the utilization heat exchangers functioning as condensers of the refrigerant as a result of the utilization switch mechanisms being switched to the heating operation switched state, and is condensed and sent to the liquid refrigerant pipe. Then, the refrigerant is evaporated in the heat source heat exchanger after passing through the expansion valve, and is taken into the compression mechanism. Here, when the heat source switch mechanism is switched to the evaporation operation switched state and operation is conducted, the refrigerant flows inside the heat source heat exchanger such that the refrigerant flows in from below and flows out from above. For this reason, when control is conducted to reduce the evaporating ability of the heat source heat exchanger by reducing the opening of the expansion valve in accordance with the air conditioning load in the utilization heat exchangers, refrigerating machine oil accumulates inside the heat source heat exchanger.

However, this air conditioner conducts the oil recovery operation where, when the heat source switch mechanism is switched to the evaporation operation switched state and operates, the refrigerant discharged from the compression mechanism is bypassed to the intake side of the compression mechanism via the first bypass circuit, the heat source switch mechanism is switched to the condensation operation switched state, and the expansion valve is closed, whereby the refrigerant discharged from the compression mechanism is caused to flow into the heat source heat exchanger, and refrigerating machine oil accumulating inside the heat source heat exchanger is returned to the intake side of the compression mechanism via the oil returning circuit. By conducting this oil recovery operation, the utilization switch mechanism is switched to the evaporation operation switched state and the orientation of the flow of the refrigerant in the entire refrigerant circuit does not have to be changed despite the fact that the heat source switch mechanism is switched to the condensation operation switched state, so that the start of returning to the operating state prior to the oil recovery operation after the oil recovery operation can be quickly conducted, the indoor comfort is not compromised, and the refrigerating machine oil accumulating inside the heat source heat exchanger can be recovered in a short amount of time.

In this manner, in this air conditioner, even when control is conducted to reduce the evaporating ability of the heat source heat exchanger by reducing the opening of the expansion valve in accordance with the air conditioning load of the utilization heat exchangers so that as a result the level of the refrigerant inside the heat source heat exchanger drops, the refrigerating machine oil does not accumulate inside the heat source heat exchanger. For this reason, the control width when the evaporating ability of the heat source heat exchanger is controlled by the expansion valve can be expanded.

Additionally, in this air conditioner, it becomes unnecessary, unlike conventional air conditioners, to dispose plural heat source heat exchangers and conduct control to reduce the evaporating ability by closing some of the plural heat source expansion valves to reduce the number of heat source heat exchangers functioning as evaporators when the heat source heat exchangers are caused to function as evaporators or to reduce the evaporating ability by causing some of the heat source heat exchangers to function as condensers to offset the evaporating ability of the heat source heat exchangers functioning as evaporators. For this reason, a wide control width of the evaporating ability can be obtained by a single heat source heat exchanger.

Thus, because simplification of the heat source heat exchanger becomes possible in an air conditioner where simplification of the heat source heat exchangers could not be realized by restricting the control width of the control of the evaporating ability of the heat source heat exchangers, increases in the number of parts and cost that had occurred in conventional air conditioners as a result of disposing plural heat source heat exchangers can be prevented. Further, the problem of the COP becoming poor in an operating condition where, when some of plural heat source heat exchangers are caused to function as condensers to reduce the evaporating ability, the amount of refrigerant compressed in the compression mechanism increases in correspondence to the amount of refrigerant condensed by the heat source heat exchangers and the air conditioning load of the utilization refrigerant circuits is small can be eliminated.

An air conditioner pertaining to a third aspect of the present invention comprises the air conditioner pertaining to the first or second aspect of the present invention, wherein a second bypass circuit that is connected between the utilization heat exchangers and the expansion valve and can branch the refrigerant from the liquid refrigerant pipe and send the refrigerant to the intake side of the compression mechanism is disposed in the liquid refrigerant pipe.

In this air conditioner, because the second bypass circuit is disposed, the refrigerant can be sent to the utilization heat exchangers functioning as condensers and the heating operation can be continued even during the oil recovery operation.

An air conditioner pertaining to a fourth aspect of the present invention comprises the air conditioner pertaining to the third aspect of the present invention, wherein a receiver that is connected between the utilization heat exchangers and the expansion valve and accumulates the refrigerant flowing through the liquid refrigerant pipe is further disposed in the liquid refrigerant pipe. The second bypass circuit is disposed such that it sends the refrigerant from an upper portion of the receiver to the intake side of the compression mechanism.

In this air conditioner, because the second bypass circuit is disposed such that it sends the refrigerant from the upper portion of the receiver to the intake side of the compression mechanism, gaseous refrigerant can be preferentially sent, and liquid refrigerant can be prevented as much as possible from being sent, to the intake side of the compression mechanism.

An air conditioner pertaining to a fifth aspect of the present invention comprises the air conditioner pertaining to any of the first to fourth aspects of the present invention, wherein the heat source heat exchanger uses, as a heat source, water supplied at a constant amount without relation to the control of the flow rate of the refrigerant flowing inside the heat source heat exchanger.

In this air conditioner, the heat source heat exchanger uses, as a heat source, water supplied at a constant amount without relation to the control of the flow rate of the refrigerant flowing inside the heat source heat exchanger, and the evaporating ability in the heat source heat exchanger cannot be controlled by controlling the water amount. However, in this air conditioner, because the control width when the evaporating ability of the heat source heat exchanger is controlled by the expansion valve is expanded, the control width when controlling the evaporating ability of the heat source heat exchanger can be ensured even without controlling the water amount.

An air conditioner pertaining to a sixth aspect of the present invention comprises the air conditioner pertaining to any of the first to fifth aspect of the present invention, wherein the heat source heat exchanger is a plate heat exchanger.

In this air conditioner, a plate heat exchanger where numerous flow paths are formed is used as the heat source heat exchanger, and it is difficult in terms of its structure to dispose, in each flow path of the heat source heat exchanger, an oil returning circuit for extracting the refrigerating machine oil in order to prevent the refrigerating machine oil from accumulating inside the heat source heat exchanger. However, in this air conditioner, the refrigerating machine oil accumulating inside the heat source heat exchanger can be extracted together with the refrigerant flowing in from the upper side of the heat source heat exchanger such that the refrigerating machine oil is swept from the lower portion of the heat source heat exchanger. For this reason, it is easy to dispose the oil returning circuit even when a plate heat exchanger is used.

An air conditioner pertaining to a seventh aspect of the present invention is disposed with a refrigerant circuit and an oil returning circuit. The refrigerant circuit includes a compressor, a heat source heat exchanger configured such that refrigerant flows in from below and flows out from above when the heat source heat exchanger functions as an evaporator of the refrigerant, and utilization heat exchangers, with the refrigerant circuit being capable of switching to cause the heat source heat exchanger and the utilization heat exchangers to function separately as evaporators or condensers of the refrigerant. The oil returning circuit connects a lower portion of the heat source heat exchanger and an intake side of the compression mechanism. Additionally, the air conditioner conducts an oil recovery operation where, when the heat source heat exchanger is caused to function and operates as an evaporator, operation is switched to an operation causing the heat source heat exchanger to function as a condenser, the refrigerant discharged from the compression mechanism is caused to flow into the heat source heat exchanger, and refrigerating machine oil accumulating inside the heat source heat exchanger is returned to the intake side of the compression mechanism via the oil returning circuit.

This air conditioner conducts the oil recovery operation where, when the heat source heat exchanger is caused to function and operates as an evaporator, the refrigerant discharged from the compression mechanism is bypassed to the intake side of the compression mechanism via the first bypass circuit, operation is switched to an operation causing the heat source heat exchanger to function as a condenser, the refrigerant discharged from the compression mechanism is caused to flow into the heat source heat exchanger, and refrigerating machine oil accumulating inside the heat source heat exchanger is returned to the intake side of the compression mechanism via the oil returning circuit. By conducting this oil recovery operation, the utilization heat exchangers are switched to evaporators and the orientation of the flow of the refrigerant in the entire refrigerant circuit does not have to be changed despite the fact that switching that causes the heat source heat exchanger to function as a condenser is conducted, so that the start of returning to the operating state prior to the oil recovery operation after the oil recovery operation can be quickly conducted, the indoor comfort is not compromised, and the refrigerating machine oil accumulating inside the heat source heat exchanger can be recovered in a short amount of time.

An air conditioner pertaining to an eighth aspect of the present invention comprises the air conditioner pertaining to the seventh aspect of the present invention, wherein the air conditioner further comprises a first bypass circuit that can bypass the refrigerant discharged from the compression mechanism to an intake side of the compression mechanism. Additionally, during the oil recovery operation, the refrigerant discharged from the compression mechanism is bypassed to the intake side of the compression mechanism via the first bypass circuit.

In this air conditioner, the intake pressure of the compression mechanism can be ensured because the refrigerant discharged from the compression mechanism is bypassed to the intake side of the compression mechanism via the first bypass circuit. Moreover, liquid compression in the compression mechanism can be prevented because the refrigerating machine oil returned to the intake side of the compression mechanism through the oil returning circuit mixes with the high-pressure gas refrigerant bypassed via the first bypass circuit.

DETAILED DESCRIPTION OF THE PREFERRED EMBODIMENTS

An embodiment of an air conditioner pertaining to the invention will be described below on the basis of the drawings.

(1) Configuration of the Air Conditioner

Figure 1:
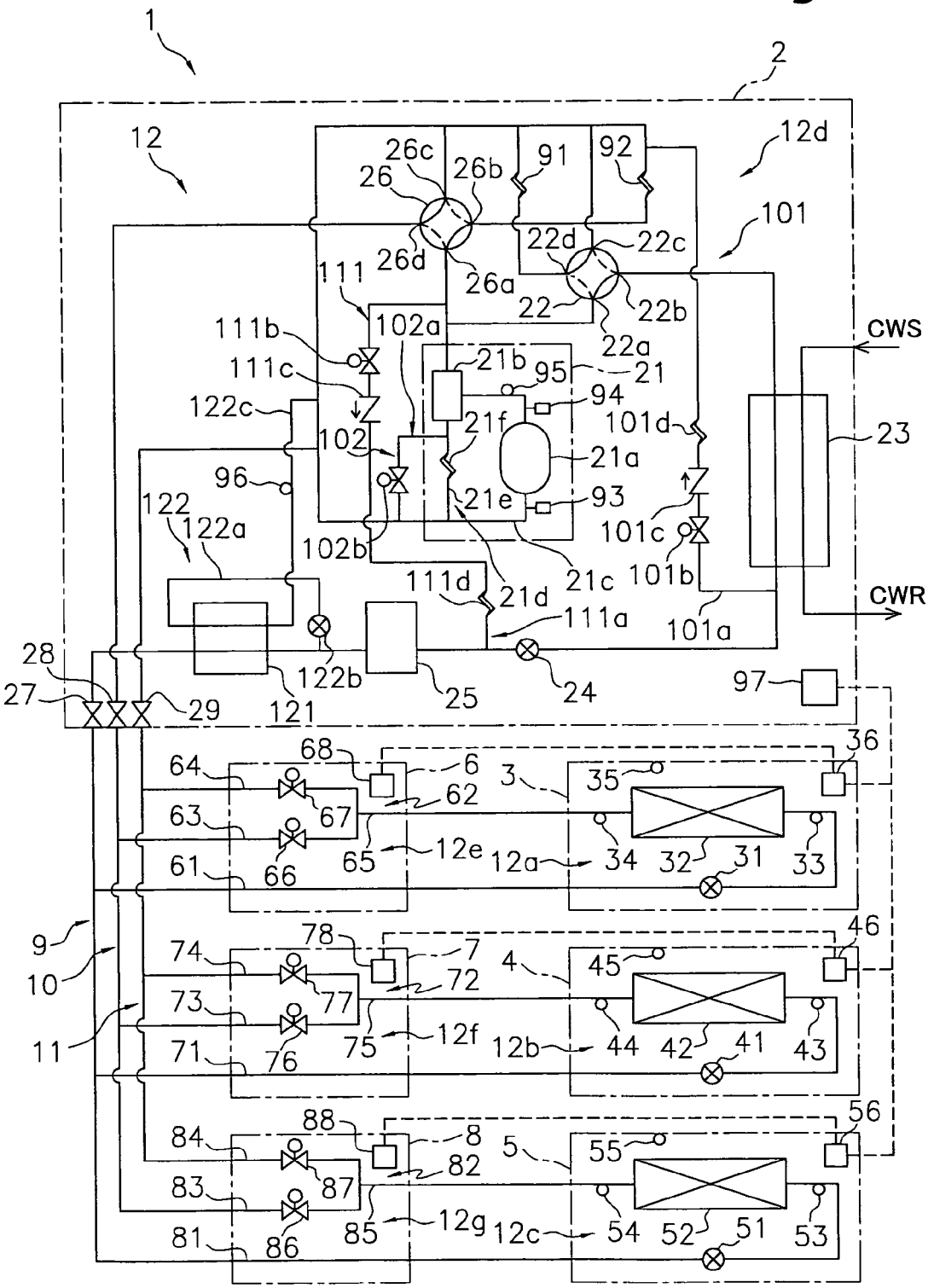
FIG. 1 A schematic diagram of a refrigerant circuit of an air conditioner of an embodiment pertaining to the invention.

FIG. 1 is a schematic diagram of a refrigerant circuit of an air conditioner 1 of an embodiment pertaining to the invention. The air conditioner 1 is an apparatus used to cool and heat the indoors of buildings and the like by conducting a vapor compression-type refrigerating cycle.

The air conditioner 1 is mainly disposed with one heat source unit 2; plural (three in the present embodiment) utilization units 3, 4 and 5; connection units 6, 7 and 8 connected to the utilization units 3, 4 and 5; and refrigerant communication pipes 9, 10 and 11 that connect the heat source unit 2 and the utilization units 3, 4 and 5 via the connection units 6, 7 and 8. The air conditioner 1 is configured such that it can conduct a simultaneous cooling and heating operation in accordance with the requirements of indoor air conditioned spaces where the utilization units 3, 4 and 5 are disposed, such as conducting a cooling operation in regard to a certain air conditioned space and conducting a heating operation in regard to another air conditioned space, for example. That is, a vapor compression-type refrigerant circuit 12 of the air conditioner 1 of the present embodiment is configured by the interconnection of the heat source unit 2, the utilization units 3, 4 and 5, the connection units 6, 7 and 8, and the refrigerant communication pipes 9, 10 and 11.

<Utilization Units>

The utilization units 3, 4 and 5 are disposed by being embedded in or hung from an indoor ceiling of a building or the like, or by being mounted on an indoor wall. The utilization units 3, 4 and 5 are connected to the heat source unit 2 via the refrigerant communication pipes 9, 10 and 11 and the connection units 6, 7 and 8, and configure part of the refrigerant circuit 12.

Next, the configuration of the utilization units 3, 4 and 5 will be described. It will be noted that because the utilization unit 3 has the same configuration as those of the utilization units 4 and 5, just the configuration of the utilization unit 3 will be described here, and in regard to the configurations of the utilization units 4 and 5, reference numerals in the 40s and 50s will be used instead of reference numerals in the 30s representing the respective portions of the utilization unit 3, and description of those respective portions will be omitted.

The utilization unit 3 mainly configures part of the refrigerant circuit 12 and is disposed with a utilization refrigerant circuit 12*a* (in the utilization units 4 and 5, utilization refrigerant circuits 12*b* and 12*c*). The utilization refrigerant circuit 12*a* is mainly disposed with a utilization expansion valve 31 and a utilization heat exchanger 32. In the present embodiment, the utilization expansion valve 31 is an electrically powered expansion valve connected to a liquid side of the utilization heat exchanger 32 in order to regulate the flow rate of the refrigerant flowing inside the utilization refrigerant circuit 12*a*. In the present embodiment, the utilization heat exchanger 32 is a cross fin-type fin-and-tube heat exchanger configured by a heat transfer tube and numerous fins, and is a device for conducting heat exchange between the refrigerant and the indoor air. In the present embodiment, the utilization unit 3 is disposed with a blower fan (not shown) for taking in indoor air to the inside of the unit, heat-exchanging the air, and thereafter supplying the air to the indoors as supply air, so that the indoor air and the refrigerant flowing through the utilization heat exchanger 32 can be heat-exchanged.

Various types of sensors are also disposed in the utilization unit 3. A liquid temperature sensor 33 that detects the temperature of liquid refrigerant is disposed at the liquid side of the utilization heat exchanger 32, and a gas temperature sensor 34 that detects the temperature of gas refrigerant is disposed at a gas side of the utilization heat exchanger 32. Moreover, an RA intake temperature sensor 35 that detects the temperature of the indoor air taken into the unit is disposed in the utilization unit 3. Further, the utilization unit 3 is disposed with a utilization control unit 36 that controls the operation of the respective portions configuring the utilization unit 3. Additionally, the utilization control unit 36 is disposed with a microcomputer and memory disposed in order to control the utilization unit 3, and is configured such that it can exchange control signals and the like with a remote controller (not shown) and exchange control signals and the like with the heat source unit 2.

<Heat Source Unit>

The heat source unit 2 is disposed on the roof or the like of a building or the like, is connected to the utilization units 3, 4 and 5 via the refrigerant communication pipes 9, 10 and 11, and configures the refrigerant circuit 12 between the utilization units 3, 4 and 5.

Next, the configuration of the heat source unit 2 will be described. The heat source unit 2 mainly configures part of the refrigerant circuit 12 and is disposed with a heat source refrigerant circuit 12*d*. The heat source refrigerant circuit 12*d* is mainly disposed with the compression mechanism 21, a first switch mechanism 22, the heat source heat exchanger 23, a heat source expansion valve 24, a receiver 25, a second switch mechanism 26, a liquid closing valve 27, a high-pressure gas closing valve 28, a low-pressure gas closing valve 29, a first oil returning circuit 101, a first bypass circuit 102, a pressurizing circuit 111, a cooler 121, and a cooling circuit 122.

The compression mechanism 21 mainly includes a compressor 21*a*, an oil separator 21*b* connected to a discharge side of the compressor 21*a*, and a second oil returning circuit 21*d* that connects the oil separator 21*b* and an intake pipe 21*c* of the compressor 21*a*. In the present embodiment, the compressor 21*a* is a positive-displacement compressor whose running capacity can be varied by inverter control. The oil separator 21*b* is a container that separates the refrigerating machine oil accompanying the high-pressure gas refrigerant compressed and discharged in the compressor 21*a*. The second oil returning circuit 21*d* is a circuit for returning the refrigerating machine oil separated in the oil separator 21*b* to the compressor 21*a*. The second oil returning circuit 21*d* mainly includes an oil returning pipe 21*e*, which connects the oil separator 21*b* and the intake pipe 21*c* of the compressor 21*a*, and a capillary tube 21*f*, which reduces the pressure of the high-pressure refrigerating machine oil separated in the oil separator 21*b* connected to the oil returning pipe 21*e*. The capillary tube 21*f* is a narrow tube that reduces, to the refrigerant pressure of the intake side of the compressor 21*a*, the pressure of the high-pressure refrigerating machine oil separated in the oil separator 21*b*. In the present embodiment, the compression mechanism 21 only has the one compressor 21*a* but is not limited thereto, and may also be one where two or more compressors are connected in parallel in accordance with the connection number of utilization units.

The first switch mechanism 22 is a four-way switch valve that can switch between flow paths of the refrigerant inside the heat source refrigerant circuit 12*d* such that when the heat source heat exchanger 23 is caused to function as a condenser (below, referred to as a condensation operation switched state), the first switch mechanism 22 connects the discharge side of the compression mechanism 21 and the gas side of the heat source heat exchanger 23, and when the heat source heat exchanger 23 is caused to function as an evaporator (below, referred to as an evaporation operation switched state), the first switch mechanism 22 connects the intake side of the compression mechanism 21 and the gas side of the heat source heat exchanger 23. A first port 22*a* of the first switch mechanism 22 is connected to the discharge side of the compression mechanism 21, a second port 22*b* of the first switch mechanism 22 is connected to the gas side of the heat source heat exchanger 23, a third port 22*c* of the first switch mechanism 22 is connected to the intake side of the compression mechanism 21, and a fourth port 22*d* of the first switch mechanism 22 is connected to the intake side of the compression mechanism 21 via a capillary tube 91. Additionally, as mentioned previously, the first switch mechanism 22 can conduct switching that connects the first port 22*a* and the second port 22*b* and connects the third port 22*c* and the fourth port 22*d* (corresponding to the condensation operation switched state; refer to the solid lines of the first switch mechanism 22 in FIG. 1), and connects the second port 22*b* and the third port 22*c* and connects the first port 22*a* and the fourth port 22*d* (corresponding to the evaporation operation switched state; refer to the dotted lines of the first switch mechanism 22 in FIG. 1).

Figure 2:
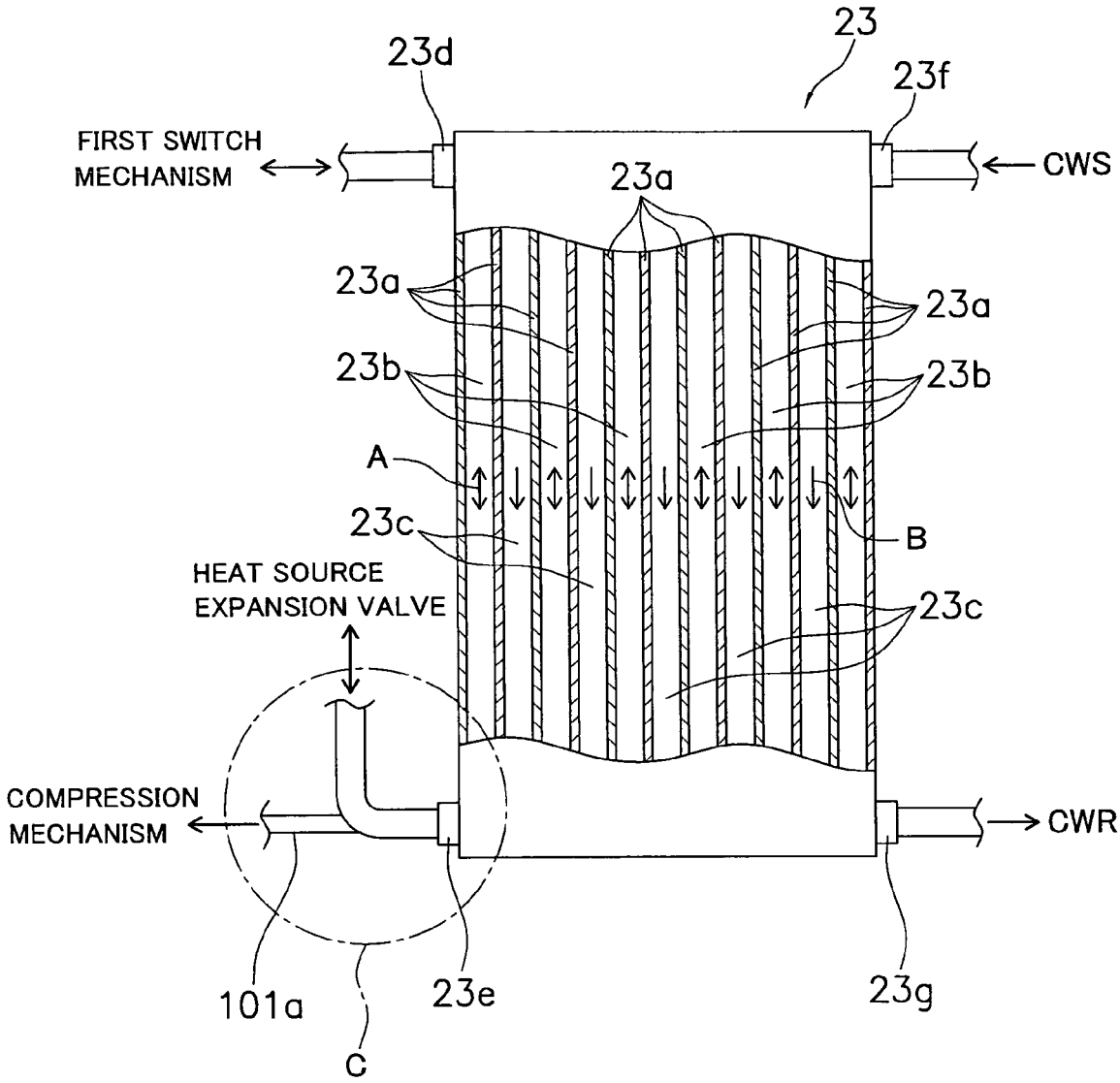
FIG. 2 A diagram showing the overall schematic structure of a heat source heat exchanger.

The heat source heat exchanger 23 is a heat exchanger that can function as an evaporator of the refrigerant and as a condenser of the refrigerant. In the present embodiment, the heat source heat exchanger 23 is a plate heat exchanger that exchanges heat with the refrigerant using water as the heat source. The gas side of the heat source heat exchanger 23 is connected to the second port 22*b* of the first switch mechanism 22, and the liquid side of the heat source heat exchanger 23 is connected to the heat source expansion valve 24. As shown in FIG. 2, the heat source heat exchanger 23 is configured such that it can conduct heat exchange as a result of plural plate members 23*a* formed by pressing or the like being superposed via packing (not shown) so that plural flow paths 23*b* and 23*c* extending in the vertical direction are formed between the plate members 23*a*, whereby the refrigerant and water alternately flow inside these plural flow paths 23*b* and 23*c* (specifically, the refrigerant flows inside the flow paths 23*b* and the water flows inside the flow paths 23*c*; refer to arrows A and B in FIG. 2). Additionally, the plural flow paths 23*b* are mutually communicated at their upper end portions and lower end portions, and are connected to a gas nozzle 23*d* and a liquid nozzle 23*e* disposed on the upper portion and the lower portion of the heat source heat exchanger 23. The gas nozzle 23*d* is connected to the first switch mechanism 22, and the liquid nozzle 23*e* is connected to the heat source expansion valve 24. Thus, when the heat source heat exchanger 23 functions as an evaporator, the refrigerant flows in from the liquid nozzle 23*e* (i.e., from below) and flows out from the gas nozzle 23*d* (i.e., from above), and when the heat source heat exchanger 23 functions as a condenser, the refrigerant flows in from the gas nozzle 23*d* (i.e., from above) and flows out from the liquid nozzle 23*e* (i.e., from below) (refer to arrow A in FIG. 2). Further, the plural flow paths 23*c* are mutually communicated at their upper end portions and lower end portions, and are connected to a water inlet nozzle 23*f* and a water outlet nozzle 23*g* disposed on the upper portion and the lower portion of the heat source heat exchanger 23. Further, in the present embodiment, the water serving as the heat source flows in as supply water CWS from the water inlet nozzle 23*f* of the heat source heat exchanger 23 through a water pipe (not shown) from a cooling tower facility or a boiler facility disposed outside the air conditioner 1, is heat-exchanged with the refrigerant, flows out from the water outlet nozzle 23*g*, and is returned as discharge water CWR to the cooling tower facility or the boiler facility. Here, a constant amount of the water supplied from the cooling tower facility or the boiler facility is supplied without relation to the flow rate of the refrigerant flowing inside the heat source heat exchanger 23.

In the present embodiment, the heat source expansion valve 24 is an electrically powered expansion valve that can regulate the flow rate of the refrigerant flowing between the heat source heat exchanger 23 and the utilization refrigerant circuits 12*a*, 12*b* and 12*c* via the liquid refrigerant communication pipe 9, and is connected to the liquid side of the heat source heat exchanger 23.

The receiver 25 is a container for temporarily accumulating the refrigerant flowing between the heat source heat exchanger 23 and the utilization refrigerant circuits 12*a*, 12*b* and 12*c*. In the present embodiment, the receiver 25 is connected between the heat source expansion valve 24 and the cooler 121.

The second switch mechanism 26 is a four-way switch valve that can switch between the flow paths of the refrigerant inside the heat source refrigerant circuit 12*d* such that when the heat source unit 2 is used as a heat source unit for a simultaneous cooling and heating machine and sends the high-pressure gas refrigerant to the utilization refrigerant circuits 12*a*, 12*b* and 12*c* (below, referred to as a heating load requirement operating state), the second switch mechanism 26 connects the discharge side of the compression mechanism 21 and the high-pressure gas closing valve 28, and when the heat source unit 2 is used as a heat source unit for a cooling and heating switching machine to conduct a cooling operation, the second switch mechanism 26 connects the high-pressure gas closing valve 28 and the intake side of the compression mechanism 21. A first port 26*a* of the second switch mechanism 26 is connected to the discharge side of the compression mechanism 21, a second port 26*b* of the second switch mechanism 26 is connected to the intake side of the compression mechanism 21 via a capillary tube 92, a third port 26*c* of the second switch mechanism 26 is connected to the intake side of the compression mechanism 21, and a fourth port 26*d* of the second switch mechanism 26 is connected to the high-pressure gas closing valve 28. Additionally, as mentioned previously, the second switch mechanism 26 can conduct switching that connects the first port 26*a* and the second port 26*b* and connects the third port 26*c* and the fourth port 26*d* (corresponding to the cooling/heating switching time cooling operating state; refer to the solid lines of the second switch mechanism 26 in FIG. 1), and connects the second port 26*b* and the third port 26*c* and connects the first port 26*a* and the fourth port 26*d* (corresponding to the heating load requirement operating state; refer to the dotted lines of the second switch mechanism 26 in FIG. 1).

The liquid closing valve 27, the high-pressure gas closing valve 28 and the low-pressure gas closing valve 29 are valves disposed at ports connected to external devices/pipes (specifically, the refrigerant communication pipes 9, 10 and 11). The liquid closing valve 27 is connected to the cooler 121. The high-pressure gas closing valve 28 is connected to the fourth port 26*d* of the second switch mechanism 26. The low-pressure gas closing valve 29 is connected to the intake side of the compression mechanism 21.

Figure 3:
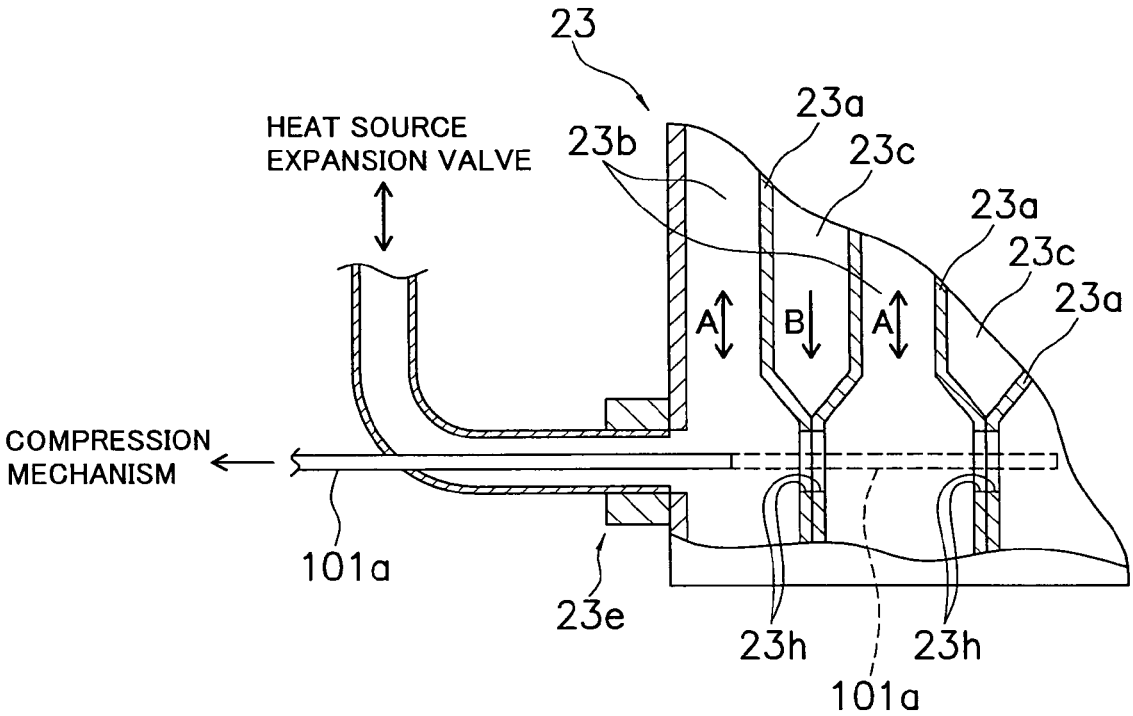
FIG. 3 An enlarged view of portion C in FIG. 2 showing the schematic structure of a lower portion of the heat source heat exchanger.

The first oil returning circuit 101 is a circuit that is used in an oil recovery operation (described later) that returns the refrigerating machine oil accumulating inside the heat source heat exchanger 23 to the intake side of the compression mechanism 21 during the evaporation operation switched state, i.e., when the heat source heat exchanger 23 is caused to function as an evaporator. The first oil returning circuit 101 is disposed such that it connects the lower portion of the heat source heat exchanger 23 and the intake side of the compression mechanism 21. The first oil returning circuit 101 mainly includes an oil returning pipe 101*a* that connects the lower portion of the heat source heat exchanger 23 and the intake side of the compression mechanism 21, a control valve 101*b* connected to the oil returning pipe 101*a*, a check valve 101*c*, and a capillary tube 101*d*. The oil returning pipe 101*a* is disposed such that one end can extract the refrigerating machine oil together with the refrigerant from the lower portion of the heat source heat exchanger 23. In the present embodiment, as shown in FIG. 3, the oil returning pipe 101*a* is a pipe extending inside the flow paths 23*b* through which flows the refrigerant of the heat source heat exchanger 23 through the inside of the pipe of the liquid nozzle 23*e* disposed in the lower portion of the heat source heat exchanger 23. Here, communication holes 23*h* are disposed in the plate members 23*a* in the heat source heat exchanger 23 in order to allow the plural flow paths 23*b* to be communicated with each other (the same is true of the plural flow paths 23*c*). For this reason, the oil returning pipe 101*a* may also be disposed such that it penetrates the plural flow paths 23*b* (refer to the oil returning pipe 101*a* indicated by the dotted lines in FIG. 3). It will be noted that because it suffices for the oil returning pipe 101*a* to be disposed such that one end can extract the refrigerating machine oil together with the refrigerant from the lower portion of the heat source heat exchanger 23, the oil returning pipe 101*a* may also be disposed in a pipe that connects the liquid nozzle 23*e* of the heat source heat exchanger 23 or the heat source heat exchanger 23 and the heat source expansion valve 24. Further, in the present embodiment, the other end of the oil returning pipe 101*a* is connected to the intake side of the compression mechanism 21. In the present embodiment, the control valve 101*b* is an electromagnetic valve that is connected to ensure that it can use the first oil returning circuit 101 as needed, and can circulate and cut off the refrigerant and the refrigerating machine oil. The check valve 101*c* is a valve that allows the refrigerant and the refrigerating machine oil to flow just inside the oil returning pipe 101*a* toward the intake side of the compression mechanism 21 from the lower portion of the heat source heat exchanger 23. The capillary tube 101*d* is a narrow tube that reduces, to the refrigerant pressure of the intake side of the compression mechanism 21, the pressure of the refrigerant and the refrigerating machine oil extracted from the lower portion of the heat source heat exchanger 23.

The first bypass circuit 102 is a circuit used in the oil recovery operation (described later) that returns the refrigerating machine oil accumulating inside the heat source heat exchanger 23 to the intake side of the compression mechanism 21 during the evaporation operation switched state, i.e., when the heat source heat exchanger 23 is caused to function as an evaporator. The first bypass circuit 102 is disposed such that it can bypass the refrigerant discharged from the compression mechanism 21 to the intake side of the compression mechanism 21. The first bypass circuit 102 mainly includes a bypass pipe 102*a*, which connects the discharge side from the compression mechanism 21 and the intake side of the compression mechanism 21, and a control valve 102*b*, which is connected to the bypass pipe 102*a*. In the present embodiment, as shown in FIG. 1, the bypass pipe 102*a* is disposed such that one end is connected to the oil returning pipe 21*e* through which flows the refrigerating machine oil separated in the oil separator 21*b*, the other end is connected to the intake side of the compression mechanism 21, and bypasses the capillary tube 21*f* disposed in the oil returning pipe 21*e* through which flows the refrigerating machine oil separated in the oil separator 21*b*. For this reason, when the control valve 102*b* of the first bypass circuit 102 is opened, the refrigerant discharged from the compression mechanism 21 flows into the first bypass circuit 102 through the oil separator 21*b* and the oil returning pipe 21*e*, and is returned to the intake side of the compression mechanism 21. It will be noted that because it suffices for the bypass pipe 102*a* to be disposed such that it can bypass the refrigerant discharged from the compression mechanism 21 to the intake side of the compression mechanism 21, the bypass pipe 102*a* may also be disposed such that it can cause the refrigerant to flow to the intake side of the compression mechanism 21 from a position upstream or downstream of the oil separator 21*b*, for example. In the present embodiment, the control valve 102*b* is an electrically powered valve that is connected to ensure that it can use the first bypass circuit 102 as needed and can circulate and cut off the refrigerant and the refrigerating machine oil.

The pressurizing circuit 111 is a circuit that causes the high-pressure gas refrigerant compressed in the compression mechanism 21 to merge with the refrigerant that is condensed in the heat source heat exchanger 23, pressure-reduced in the heat source expansion valve 24, and sent to the utilization refrigerant circuits 12*a*, 12*b* and 12*c* during the condensation operation switched state, i.e., when the heat source heat exchanger 23 is caused to function as a condenser. The pressurizing circuit 111 mainly includes a pressurizing pipe 111*a* that connects the discharge side of the compression mechanism 21 and the downstream side of the heat source expansion valve 24 (i.e., between the heat source expansion valve 24 and the liquid closing valve 27), a control valve 111*b* connected to the pressurizing pipe 111*a*, a check valve 111*c*, and a capillary tube 111*d*. In the present embodiment, one end of the pressurizing pipe 111*a* is connected between the outlet of the oil separator 21*b* of the compression mechanism 21 and the first ports 22*a* and 26*a* of the first and second switch mechanisms 22 and 26. Further, in the present embodiment, the other end of the pressurizing pipe 111*a* is connected between the heat source expansion valve 24 and the receiver 25. In the present embodiment, the control valve 111*b* is an electromagnetic valve that is connected to ensure that it can use the pressurizing circuit 111 as needed, and can circulate and cut off the refrigerant. The check valve 111*c* is a valve that allows the refrigerant to flow just inside the pressurizing pipe 111*a* toward the downstream side of the heat source expansion valve 24 from the discharge side of the compression mechanism 21. The capillary tube 111*d* is a narrow tube that reduces, to the refrigerant pressure of the downstream side of the heat source expansion valve 24, the pressure of the refrigerant extracted from the discharge side of the compression mechanism 21.

The cooler 121 is a heat exchanger that cools the refrigerant that is condensed in the heat source heat exchanger 23, pressure-reduced in the heat source expansion valve 24, and sent to the utilization refrigerant circuits 12*a*, 12*b* and 12*c* during the condensation operation switched state, i.e., when the heat source heat exchanger 23 is caused to function as a condenser. In the present embodiment, the cooler 121 is connected between the receiver 25 and the liquid closing valve 27. In other words, the pressurizing circuit 111 is connected such that the pressurizing pipe 111*a* is connected between the heat source expansion valve 24 and the cooler 121, so that the high-pressure gas refrigerant merges with the refrigerant whose pressure has been reduced in the heat source expansion valve 24. A double tube heat exchanger, for example, can be used as the cooler 121.

The cooling circuit 122 is a circuit connected to the heat source refrigerant circuit 12*d* such that during the condensation operation switched state, i.e., when the heat source heat exchanger 23 is caused to function as a condenser, the cooling circuit 122 causes some of the refrigerant sent from the heat source heat exchanger 23 to the utilization refrigerant circuits 12*a*, 12*b* and 12*c* to branch from the heat source refrigerant circuit 12*d* and be introduced to the cooler 121, cools the refrigerant that is condensed in the heat source heat exchanger 23, pressure-reduced in the heat source expansion valve 24, and sent to the utilization refrigerant circuits 12*a*, 12*b* and 12*c*, and returns the refrigerant to the intake side of the compression mechanism 21. The cooling circuit 122 mainly includes a lead-in pipe 122*a* that introduces to the cooler 121 some of the refrigerant sent from the heat source heat exchanger 23 to the utilization refrigerant circuits 12*a*, 12*b* and 12*c*, a cooling circuit expansion valve 122*b* connected to the lead-in pipe 122*a*, and a lead-out pipe 122*c* that returns, to the intake side of the compression mechanism 21, the refrigerant passing through the cooler 121. In the present embodiment, one end of the lead-in pipe 122*a* is connected between the receiver 25 and the cooler 121. Further, in the present embodiment, the other end of the lead-in pipe 122*a* is connected to the inlet of the cooling circuit 122 side of the cooler 121. In the present embodiment, the cooling circuit expansion valve 122*b* is an electrically powered expansion valve that is connected to ensure that it can use the cooling circuit 122 as needed, and can regulate the flow rate of the refrigerant flowing through the cooling circuit 122. In the present embodiment, one end of the lead-out pipe 122*c* is connected to the outlet of the cooling circuit 122 side of the cooler 121. Further, in the present embodiment, the other end of the lead-out pipe 122*c* is connected to the intake side of the compression mechanism 21.

Further, various types of sensors are disposed in the heat source unit 2. Specifically, the heat source unit 2 is disposed with an intake pressure sensor 93 that detects the intake pressure of the compression mechanism 21, a discharge pressure sensor 94 that detects the discharge pressure of the compression mechanism 21, a discharge temperature sensor 95 that detects the discharge temperature of the refrigerant of the discharge side of the compression mechanism 21, and a cooling circuit outlet temperature sensor 96 that detects the temperature of the refrigerant flowing through the lead-out pipe 122*c* of the cooling circuit 122. Further, the heat source unit 2 is disposed with a heat source control unit 97 that controls the operation of the respective portions configuring the heat source unit 2. Additionally, the heat source control unit 97 includes a microcomputer and a memory disposed in order to control the heat source unit 2, and is configured such that it can exchange control signals and the like with the utilization control units 36, 46 and 56 of the utilization units 3, 4 and 5.

<Connection Units>

The connection units 6, 7 and 8 are disposed together with the utilization units 3, 4 and 5 inside the room of a building or the like. The connection units 6, 7 and 8 are intervened between the utilization units 3, 4 and 5 and the heat source unit 2 together with the refrigerant communication pipes 9, 10 and 11, and configure part of the refrigerant circuit 12.

Next, the configuration of the connection units 6, 7 and 8 will be described. It will be noted that because the connection unit 6 has the same configuration as those of the connection units 7 and 8, just the configuration of the connection unit 6 will be described here, and in regard to the configurations of the connection units 7 and 8, reference numerals in the 70s and 80s will be used instead of reference numerals in the 60s representing the respective portions of the connection unit 6, and description of those respective portions will be omitted.

The connection unit 6 mainly configures part of the refrigerant circuit 12 and is disposed with a connection refrigerant circuit 12*e* (in the connection units 7 and 8, connection refrigerant circuits 12*f* and 12*g*). The connection refrigerant circuit 12*e* mainly includes a liquid connection pipe 61, a gas connection pipe 62, a high-pressure gas control valve 66, and a low-pressure gas control valve 67. In the present embodiment, the liquid connection pipe 61 connects the liquid refrigerant communication pipe 9 and the utilization expansion valve 31 of the utilization refrigerant circuit 12*a*. The gas connection pipe 62 includes a high-pressure gas connection pipe 63 connected to the high-pressure gas refrigerant communication pipe 10, a low-pressure gas connection pipe 64 connected to the low-pressure gas refrigerant communication pipe 11, and a junction gas connection pipe 65 that merges the high-pressure gas connection pipe 63 and the low-pressure gas connection pipe 64. The junction gas connection pipe 65 is connected to the gas side of the utilization heat exchanger 32 of the utilization refrigerant circuit 12*a*. Additionally, in the present embodiment, the high-pressure gas control valve 66 is an electromagnetic valve that is connected to the high-pressure gas connection pipe 63 and can circulate and cut off the refrigerant. In the present embodiment, the low-pressure gas control valve 67 is an electromagnetic valve that is connected to the low-pressure gas connection pipe 64 and can circulate and cut off the refrigerant. Thus, when the utilization unit 3 conducts the cooling operation (below, referred to as a cooling operation switched state), the connection unit 6 can function to close the high-pressure gas control valve 66 and open the low-pressure gas control valve 67 such that the refrigerant flowing into the liquid connection pipe 61 through the liquid refrigerant communication pipe 9 is sent to the utilization expansion valve 31 of the utilization refrigerant circuit 12*a*, pressure-reduced by the utilization expansion valve 31, evaporated in the utilization heat exchanger 32, and thereafter returned to the low-pressure gas refrigerant communication pipe 11 through the junction gas connection pipe 65 and the low-pressure gas connection pipe 64. Further, when the utilization unit 3 conducts the heating operation (below, referred to as a heating operation switched state), the connection unit 6 can function to close the low-pressure gas control valve 67 and open the high-pressure gas control valve 66 such that the refrigerant flowing into the high-pressure gas connection pipe 63 and the junction gas connection pipe 65 through the high-pressure gas refrigerant communication pipe 10 is sent to the gas side of the utilization heat exchanger 32 of the utilization refrigerant circuit 12*a*, condensed in the utilization heat exchanger 32, pressure-reduced by the utilization expansion valve 31, and thereafter returned to the liquid refrigerant communication pipe 9 through the liquid connection pipe 61. Further, the connection unit 6 is disposed with a connection control unit 68 that controls the operation of the respective portions configuring the connection unit 6. Additionally, the connection control unit 68 includes a microcomputer and a memory disposed in order to control the connection unit 6, and is configured such that it can exchange control signals and the like with the utilization control unit 36 of the connection unit 3.

As described above, the refrigerant circuit 12 of the air conditioner 1 is configured by the interconnection of the utilization refrigerant circuits 12*a*, 12*b* and 12*c*, the heat source refrigerant circuit 12*d*, the refrigerant communication pipes 9, 10 and 11, and the connection refrigerant circuits 12*e*, 12*f* and 12*g*. In other words, the refrigerant circuit 12 comprises: the compression mechanism 21; the heat source heat exchanger 23 configured such that refrigerant flows in from below and flows out from above when the heat source heat exchanger 23 functions as an evaporator of the refrigerant; the utilization heat exchangers 32, 42 and 52; the liquid refrigerant pipe including the liquid refrigerant communication pipe 9 that connects the heat source heat exchanger 23 and the utilization heat exchangers 32, 42 and 52; the heat source expansion valve 24 disposed in the liquid refrigerant pipe; the first switch mechanism 22 serving as a heat source switch mechanism that can switch between the condensation operation switched state that causes the heat source heat exchanger 23 to function as a condenser of the refrigerant discharged from the compression mechanism 21 and the evaporation operation switched state that causes the heat source heat exchanger 23 to function as an evaporator of the refrigerant flowing through the liquid refrigerant pipe; the high-pressure gas refrigerant pipe including the high-pressure gas refrigerant communication pipe 10 that is connected between the discharge side of the compression mechanism 21 and the first switch mechanism 22 and causes the refrigerant discharged from the compression mechanism 21 to branch before flowing into the first switch mechanism 22; the connection units 6, 7 and 8 (specifically, the high-pressure gas control valves 66, 76 and 86 and the low-pressure gas control valves 67, 77 and 87) serving as utilization switch mechanisms that can switch between the cooling operation switched state that causes the utilization heat exchangers 32, 42 and 52 to function as evaporators of the refrigerant flowing through the liquid refrigerant pipe and the heating operation switched state that causes the utilization heat exchangers 32, 42 and 52 to function as condensers of the refrigerant flowing through the high-pressure gas refrigerant pipe; and the low-pressure gas refrigerant pipe including the low-pressure gas refrigerant communication pipe 11 that sends, to the intake side of the compression mechanism 21, the refrigerant evaporated in the utilization heat exchangers 32, 42 and 52, wherein the refrigerant circuit 12 is capable of switching that causes the heat source heat exchanger 23 and the utilization heat exchangers 32, 42 and 52 to function separately as evaporators or condensers of the refrigerant. Thus, the air conditioner 1 of the present embodiment can conduct a simultaneous cooling and heating operation, such as the utilization unit 5 conducting a heating operation while the utilization units 3 and 5 conduct a cooling operation, for example.

Additionally, in the air conditioner 1 of the present embodiment, as will be described later, the control width when the evaporating ability of the heat source heat exchanger 23 is controlled by the heat source expansion valve 24 is expanded because the refrigerating machine oil is prevented from accumulating inside the heat source heat exchanger 23 by using the first oil returning circuit 101 and the first bypass circuit 102 to conduct an oil recovery operation when the heat source heat exchanger 23 is caused to function as an evaporator, so that a wide control width of the evaporating ability can be obtained by the single heat source heat exchanger 23. Further, in the air conditioner 1, as will be described later, the control width when the condensing ability of the heat source heat exchanger 23 is controlled by the heat source expansion valve 24 is expanded by using the pressurizing circuit 111 and the cooler 121 when the heat source heat exchanger 23 is caused to function as a condenser, so that a wide control width of the condensing ability can be obtained by the single heat source heat exchanger 23. Thus, in the air conditioner 1 of the present embodiment, simplification of the heat source heat exchanger, which had been plurally disposed in conventional air conditioners, is realized.

(2) Operation of the Air Conditioner

Next, the operation of the air conditioner 1 of the present embodiment will be described.

The operating modes of the air conditioner 1 of the present embodiment can be divided in accordance with the air conditioning load of each of the utilization units 3, 4 and 5 into a heating operating mode where all of the utilization units 3, 4 and 5 conduct the heating operation, a cooling operating mode where all of the utilization units 3, 4 and 5 conduct the cooling operation, and a simultaneous cooling and heating operating mode where some of the utilization units 3, 4 and 5 conduct the cooling operation while the other utilization units conduct the heating operation. Further, in regard to the simultaneous cooling and heating operating mode, the operating mode can be divided by the overall air conditioning load of the utilization units 3, 4 and 5 into when the heat source heat exchanger 23 of the heat source unit 2 is caused to function and operate as an evaporator (evaporation operation switched state) and when the heat source heat exchanger 23 of the heat source unit 2 is caused to function and operate as a condenser (condensation operation switched state).

The operation of the air conditioner 1 in the four operating modes will be described below.

<Heating Operating Mode>

Figure 4:
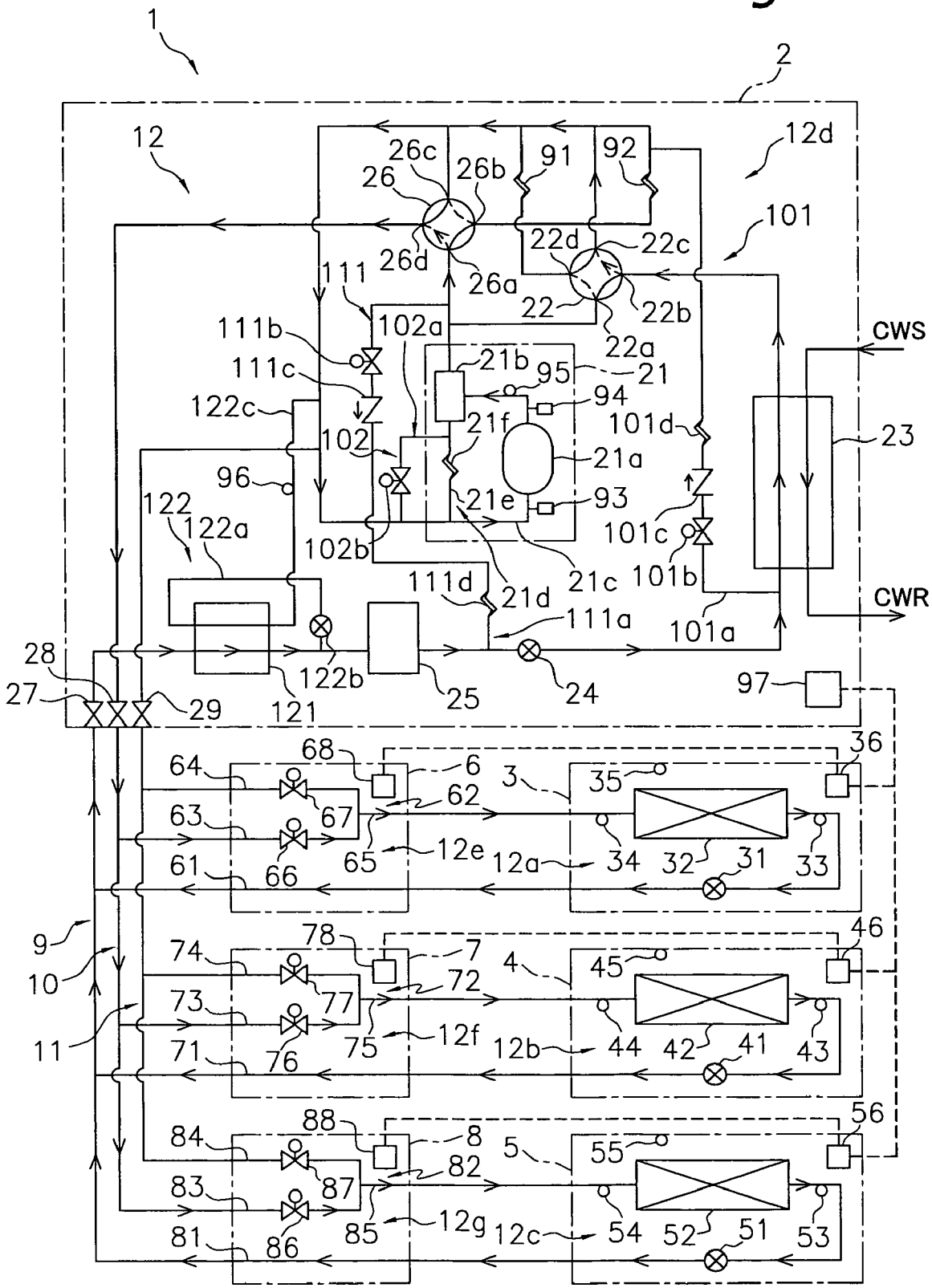
FIG. 4 A schematic diagram of the refrigerant circuit describing the operation during a heating operating mode of the air conditioner.

When all of the utilization units 3, 4 and 5 conduct the heating operation, the refrigerant circuit 12 of the air conditioner 1 is configured as shown in FIG. 4 (refer to the arrows added to the refrigerant circuit 12 in FIG. 4 for the flow of the refrigerant). Specifically, in the heat source refrigerant circuit 12*d* of the heat source unit 2, the first switch mechanism 22 is switched to the evaporation operation switched state (the state indicated by the dotted lines of the first switch mechanism 22 in FIG. 4) and the second switch mechanism 26 is switched to the heating load requirement operating state (the state indicated by the dotted lines of the second switch mechanism 26 in FIG. 4), whereby the heat source heat exchanger 23 is caused to function as an evaporator such that the high-pressure gas refrigerant compressed and discharged in the compression mechanism 21 can be supplied to the utilization units 3, 4 and 5 through the high-pressure gas refrigerant communication pipe 10. Further, the opening of the heat source expansion valve 24 is regulated to reduce the pressure of the refrigerant. It will be noted that the control valve 111*b* of the pressurizing circuit 111 and the cooling circuit expansion valve 122*b* of the cooling circuit 122 are closed so that the high-pressure gas refrigerant is caused to merge with the refrigerant flowing between the heat source expansion valve 24 and the receiver 25, the supply of the cooling source to the cooler 121 is shut off, and the refrigerant flowing between the receiver 25 and the utilization units 3, 4 and 5 is not cooled. In the connection units 6, 7 and 8, the low-pressure gas control valves 67, 77 and 87 are closed and the high-pressure gas control valves 66, 76 and 86 are opened, whereby the utilization heat exchangers 32, 42 and 52 of the utilization units 3, 4 and 5 are caused to function as condensers (i.e., the heating operation switched state). In the utilization units 3, 4 and 5, the openings of the utilization expansion valves 31, 41 and 51 are regulated in accordance with the heating load of each utilization unit, such as the openings being regulated on the basis of the degree of subcooling of the utilization heat exchangers 32, 42 and 52 (specifically, the temperature difference between the refrigerant temperature detected by the liquid temperature sensors 33, 43 and 53 and the refrigerant temperature detected by the gas temperature sensors 34, 44 and 54), for example.

In this configuration of the refrigerant circuit 12, a large portion of the refrigerating machine oil accompanying the high-pressure gas refrigerant that has been compressed and discharged by the compressor 21*a* of the compression mechanism 21 is separated in the oil separator 21*b* from this high-pressure gas refrigerant, and the high-pressure gas refrigerant is sent to the second switch mechanism 26. Then, the refrigerating machine oil separated in the oil separator 21*b* is returned to the intake side of the compressor 21*a* through the second oil returning circuit 21*d*. The high-pressure gas refrigerant sent to the second switch mechanism 26 is sent to the high-pressure gas refrigerant communication pipe 10 through the first port 26*a* and the fourth port 26*d* of the second switch mechanism 26 and the high-pressure gas closing valve 28.

Then, the high-pressure gas refrigerant sent to the high-pressure gas refrigerant communication pipe 10 is branched into three and sent to the high-pressure gas connection pipes 63, 73 and 83 of the connection units 6, 7 and 8. The high-pressure gas refrigerant sent to the high-pressure gas connection pipes 63, 73 and 83 of the connection units 6, 7 and 8 is sent to the utilization heat exchangers 32, 42 and 52 of the utilization units 3, 4 and 5 through the high-pressure gas control valves 66, 76 and 86 and the junction gas connection pipes 65, 75 and 85.

Then, the high-pressure gas refrigerant sent to the utilization heat exchangers 32, 42 and 52 is condensed in the utilization heat exchangers 32, 42 and 52 of the utilization units 3, 4 and 5 as a result of heat exchange being conducted with the indoor air. The indoor air is heated and supplied to the indoors. The refrigerant condensed in the utilization heat exchangers 32, 42 and 52 passes through the utilization expansion valves 31, 41 and 51 and is thereafter sent to the liquid connection pipes 61, 71 and 81 of the connection units 6, 7 and 8.

Then, the refrigerant sent to the liquid connection pipes 61, 71 and 81 is sent to the liquid refrigerant communication pipe 9 and merges.

Then, the refrigerant that has been sent to the liquid refrigerant communication pipe 9 and merged is sent to the receiver 25 through the liquid closing valve 27 and the cooler 121 of the heat source unit 2. The refrigerant sent to the receiver 25 is temporarily accumulated inside the receiver 25, and the pressure of the refrigerant is thereafter reduced by the heat source expansion valve 24. Then, the refrigerant whose pressure has been reduced by the heat source expansion valve 24 is evaporated in the heat source heat exchanger 23 as a result of heat exchange being conducted with water serving as a heat source, becomes low-pressure gas refrigerant, and is sent to the first switch mechanism 22. Then, the low-pressure gas refrigerant sent to the first switch mechanism 22 is returned to the intake side of the compression mechanism 21 through the second port 22*b* and the third port 22*c* of the first switch mechanism 22. In this manner, the operation in the heating operating mode is conducted.

At this time, there are cases where the heating loads of the utilization units 3, 4 and 5 become extremely small. In such cases, it is necessary to reduce the refrigerant evaporating ability in the heat source heat exchanger 23 of the heat source unit 2 and balance the overall heating load of the utilization units 3, 4 and 5 (specifically, the condensation loads of the utilization heat exchangers 32, 42 and 52). For this reason, control is conducted to reduce the evaporation amount of the refrigerant in the heat source heat exchanger 23 by conducting control to reduce the opening of the heat source expansion valve 24. When control is conducted to reduce the opening of the heat source expansion valve 24, the level of the refrigerant inside the heat source heat exchanger 23 drops. Thus, in a heat exchanger configured such that the refrigerant flows in from below and flows out from above when the heat exchanger functions as an evaporator of the refrigerant (see FIG. 2 and FIG. 3), like the heat source heat exchanger 23 of the present embodiment, it becomes difficult for the refrigerating machine oil to be discharged together with the evaporated refrigerant, and it becomes easy for accumulation of the refrigerating machine oil to occur.

Figure 5:
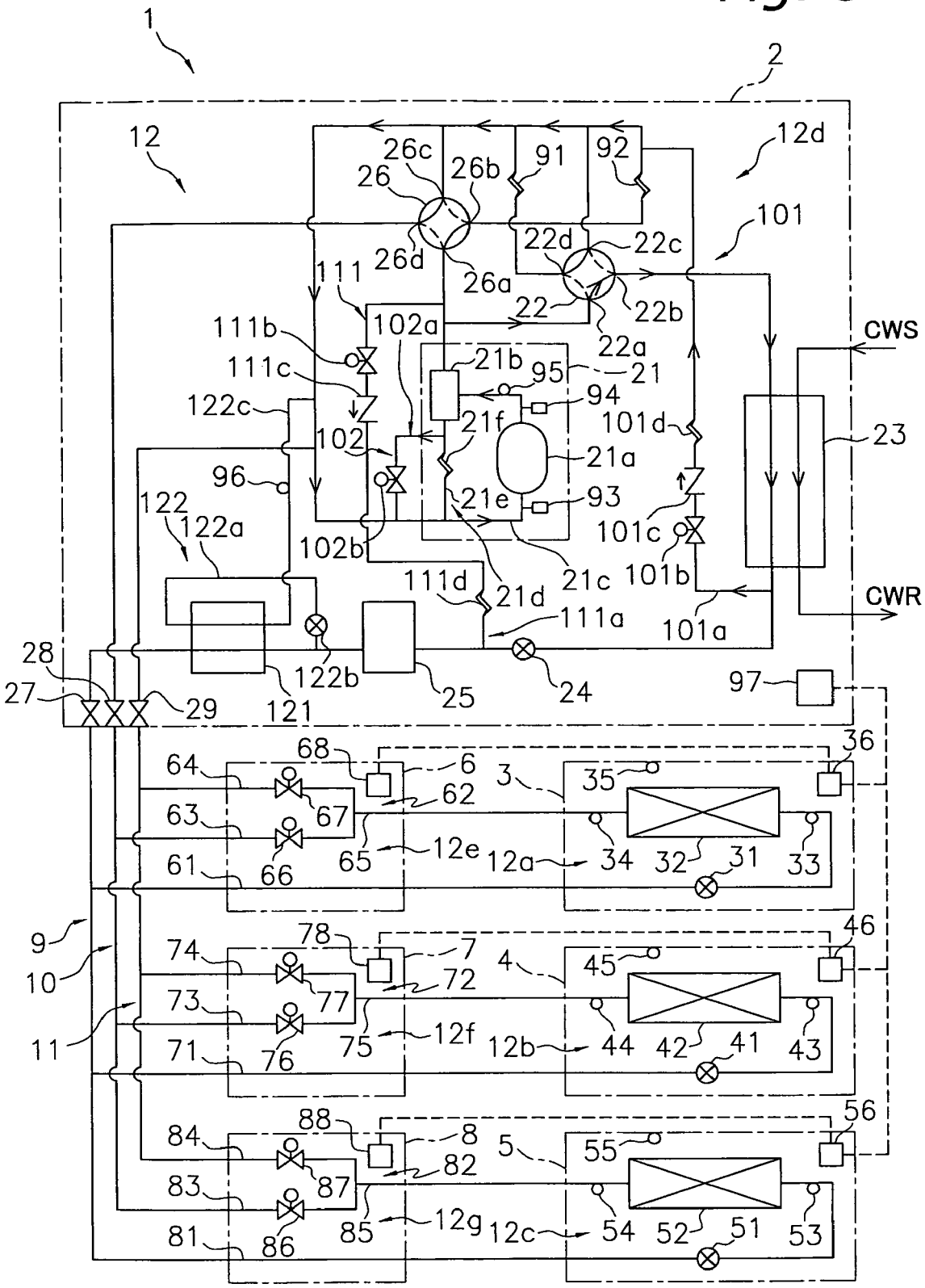
FIG. 5 A schematic diagram of the refrigerant circuit describing the operation of an oil recovery operation during the heating operating mode of the air conditioner.

However, in the air conditioner 1 of the present embodiment, the first oil returning circuit 101 and the first bypass circuit 102 are disposed. Additionally, in the air conditioner 1, when the first switch mechanism 22 is switched to and operates in the evaporation operation switching state, as shown in FIG. 5, the oil recovery operation is conducted by temporarily opening the control valve 102*b* so that the refrigerant discharged from the compression mechanism 21 is bypassed via the first bypass circuit 102 to the intake side of the compression mechanism 21, switching the first switch mechanism 22 to the condensation operation switched state (the state indicated by the solid lines of the first switch mechanism 22 in FIG. 5), and closing the heat source expansion valve 24 and opening the control valve 101*b*, and thereafter the air conditioner 1 is returned to the operating state shown in FIG. 4 prior to the oil recovery operation by closing the control valve 101*b*, opening the heat source expansion valve 24, and closing the control valve 102*b*.

To describe in detail this oil recovery operation and the operation of returning to the operating state prior to the oil recovery operation, first, when the control valve 102*b* of the first bypass circuit 102 is opened, some of the high-pressure gas refrigerant compressed and discharged by the compressor 21*a* of the compression mechanism 21 passes through the oil separator 21*b* and is sent to the first switch mechanism 22 and the second switch mechanism 26, and the remaining high-pressure gas refrigerant is sent from the oil separator 21*b* to the compression mechanism 21 through the first bypass circuit 102. Next, when the heat source expansion valve 24 is closed, the high-pressure gas refrigerant that had been sent to the second switch mechanism 26 is sent to the intake side of the compression mechanism 21 through the first bypass circuit 102 because the flow of the refrigerant returning to the heat source heat exchanger 23 from the second switch mechanism 26 through the high-pressure gas refrigerant communication pipe 10, the connection units 6, 7 and 8, the utilization units 3, 4 and 5, and the liquid refrigerant communication pipe 9 is stopped. Next, when the control valve 101*b* of the first oil returning circuit 101 is opened after the first switch mechanism 22 is switched to the condensation operation switched state, the high-pressure gas refrigerant flows in from the upper side of the heat source heat exchanger 23 through the first switch mechanism 22 and flows toward the lower side, and the refrigerating machine oil accumulating inside the heat source heat exchanger 23 is swept to the intake side of the compression mechanism 21 through the first oil returning circuit 101 (see FIG. 5). Then, after the oil recovery operation ends, the air conditioner 1 returns to the operating state prior to the oil recovery operation by closing the control valve 101*b*, switching the first switch mechanism 22 to the evaporation operation switched state, opening the heat source expansion valve 24, and closing the control valve 102*b* (see FIG. 4). Here, the reason the refrigerant discharged from the compression mechanism 21 is bypassed to the intake side of the compression mechanism 21 via the first bypass circuit 102 during the oil recovery operation is to ensure the intake pressure of the compression mechanism 21 and to prevent liquid compression in the compression mechanism 21 by mixing the refrigerating machine oil returned to the intake side of the compression mechanism 21 through the first oil returning circuit 101 with the high-pressure gas refrigerant bypassed via the first bypass circuit 102. It will be noted that the order in which the control valves 101*b* and 102*b*, the heat source expansion valve 24 and the first switch mechanism 22 are opened and closed is not limited to the above, but from the standpoint of securing a flow path of the high-pressure gas refrigerant discharged from the compression mechanism 21, it is preferable to conduct the operation of opening the control valve 102*b* before other operations when conducting the oil recovery operation and to conduct the operation of closing the control valve 102*b* after other operations have been conducted when returning to the operating state prior to the oil recovery operation.

By conducting this oil recovery operation, the high-pressure gas control valves 66, 76 and 86 and the low-pressure gas control valves 67, 77 and 87 of the connection units 6, 7 and 8 serving as utilization switch mechanisms are switched to the cooling operation switched state despite the fact that the first switch mechanism 22 is temporarily switched to the condensation operation switched state, the start of returning to the operating state prior to the oil recovery operation after the oil recovery operation can be quickly conducted because the orientation of the flow of the refrigerant in the entire refrigerant circuit 12 does not have to be changed, the indoor comfort is not compromised, and the refrigerating machine oil accumulating inside the heat source heat exchanger 23 can be recovered in a short amount of time.

It will be noted that the oil recovery operation may be periodically conducted when the first switch mechanism 22 is switched to and operates in the evaporation operation switched state, or in order to reduce the frequency of the oil recovery operation, may be periodically conducted just when the first switch mechanism 22 is switched to and operates in the evaporation operation switched state and where the level of the refrigerant inside the heat source heat exchanger 23 drops as a result of conducting control to reduce the opening of the heat source expansion valve 24 and it becomes difficult for the refrigerating machine oil to be discharged together with the evaporated refrigerant. For example, the conditions under which the oil recovery operation is conducted may be when the first switch mechanism 22 is in the evaporation operation switched state and when the heat source expansion valve 24 is equal to or less than a predetermined opening. The opening of the heat source expansion valve 24 when the level of the refrigerant inside the heat source heat exchanger 23 drops and it becomes difficult for the refrigerating machine oil to be discharged together with the evaporated refrigerant is found experimentally, and the predetermined opening is determined on the basis of the experimentally found opening.

<Cooling Operating Mode>

Figure 6:
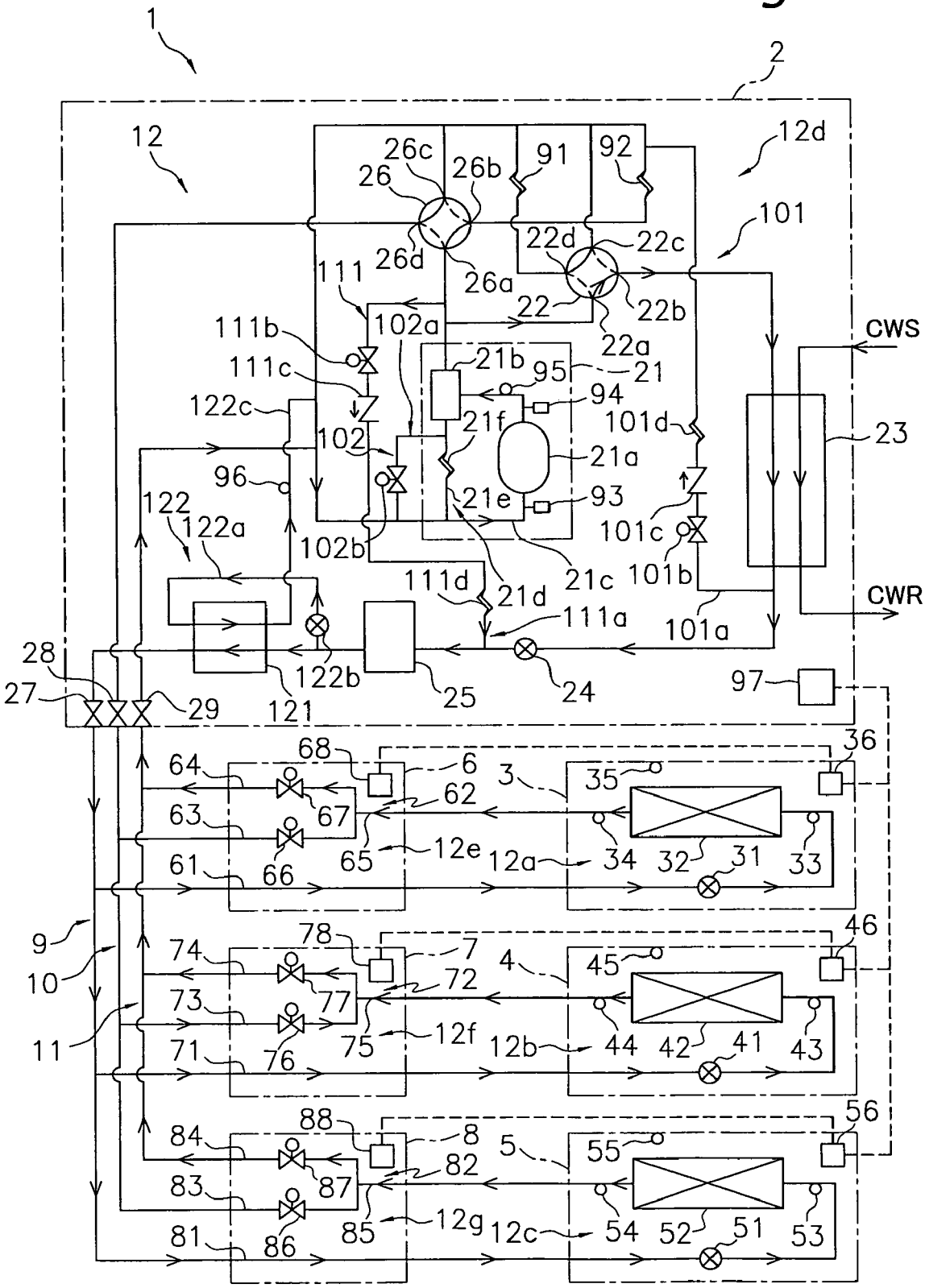
FIG. 6 A schematic diagram of the refrigerant circuit describing the operation during a cooling operating mode of the air conditioner.

When all of the utilization units 3, 4 and 5 conduct the cooling operation, the refrigerant circuit 12 of the air conditioner 1 is configured as shown in FIG. 6 (refer to the arrows added to the refrigerant circuit 12 in FIG. 6 for the flow of the refrigerant). Specifically, in the heat source refrigerant circuit 12*d* of the heat source unit 2, the first switch mechanism 22 is switched to the condensation operating state (the state indicated by the solid lines of the first switch mechanism 22 in FIG. 6), whereby the heat source heat exchanger 23 is caused to function as a condenser. Further, the heat source expansion valve 24 is opened. It will be noted that the control valve 101*b* of the first oil returning circuit 101 and the control valve 102*b* of the first bypass circuit 102 are closed so that the oil recovery operation using these circuits is not conducted. In the connection units 6, 7 and 8, the high-pressure gas control valves 66, 76 and 86 are closed and the low-pressure gas control valves 67, 77 and 87 are opened, whereby the utilization heat exchangers 32, 42 and 52 of the utilization units 3, 4 and 5 are caused to function as evaporators, and the utilization heat exchangers 32, 42 and 52 of the utilization units 3, 4 and 5 and the intake side of the compression mechanism 21 of the heat source unit 2 become connected via the low-pressure gas refrigerant communication pipe 11 (i.e., the cooling operation switched state). In the utilization units 3, 4 and 5, the openings of the utilization expansion valves 31, 41 and 51 are regulated in accordance with the cooling load of each utilization unit, such as the openings being regulated on the basis of the degree of superheat of the utilization heat exchangers 32, 42 and 52 (specifically, the temperature difference between the refrigerant temperature detected by the liquid temperature sensors 33, 43 and 53 and the refrigerant temperature detected by the gas temperature sensors 34, 44 and 54), for example.

In this configuration of the refrigerant circuit 12, a large portion of the refrigerating machine oil accompanying the high-pressure gas refrigerant that has been compressed and discharged by the compressor 21*a* of the compression mechanism 21 is separated in the oil separator 21*b* from this high-pressure gas refrigerant, and the high-pressure gas refrigerant sent to the first switch mechanism 22. Then, the refrigerating machine oil separated in the oil separator 21*b* is returned to the intake side of the compressor 21*a* through the second oil returning circuit 21*d*. Then, the high-pressure gas refrigerant sent to the first switch mechanism 22 is sent to the heat source heat exchanger 23 through the first port 22*a* and the second port 22*b* of the first switch mechanism 22. Then, the high-pressure gas refrigerant sent to the heat source heat exchanger 23 is condensed in the heat source heat exchanger 23 as a result of heat exchange being conducted with water serving as a heat source. Then, the refrigerant condensed in the heat source heat exchanger 23 passes through the heat source expansion valve 24, the high-pressure gas refrigerant that has been compressed and discharged by the compression mechanism 21 merges therewith through the pressurizing circuit 111 (the details will be described later), and the refrigerant is sent to the receiver 25. Then, the refrigerant sent to the receiver 25 is temporarily accumulated inside the receiver 25 and thereafter sent to the cooler 121. Then, the refrigerant sent to the cooler 121 is cooled as a result of heat exchange being conducted with the refrigerant flowing through the cooling circuit 122 (the details will be described later). Then, the refrigerant cooled in the cooler 121 is sent to the liquid refrigerant communication pipe 9 through the liquid closing valve 27.

Then, the refrigerant sent to the liquid refrigerant communication pipe 9 is branched into three and sent to the liquid connection pipes 61, 71 and 81 of the connection units 6, 7 and 8. Then, the refrigerant sent to the liquid connection pipes 61, 71 and 81 of the connection units 6, 7 and 8 is sent to the utilization expansion valves 31, 41 and 51 of the utilization units 3, 4 and 5.

Then, the pressure of the refrigerant sent to the utilization expansion valves 31, 41 and 51 is reduced by the utilization expansion valves 31, 41 and 51, and the refrigerant is thereafter evaporated in the utilization heat exchangers 32, 42 and 52 as a result of heat exchange being conducted with the indoor air and becomes low-pressure gas refrigerant. The indoor air is cooled and supplied to the indoors. Then, the low-pressure gas refrigerant is sent to the junction gas connection pipes 65, 75 and 85 of the connection units 6, 7 and 8.

Then, the low-pressure gas refrigerant sent to the junction gas connection pipes 65, 75 and 85 is sent to the low-pressure gas refrigerant communication pipe 11 through the low-pressure gas control valves 67, 77 and 87 and the low-pressure gas connection pipes 64, 74 and 84, and merges.

Then, the low-pressure gas refrigerant that has been sent to the low-pressure gas refrigerant communication pipe 11 and merged is returned to the intake side of the compression mechanism 21 through the low-pressure gas closing valve 29. In this manner, the operation in the cooling operating mode is conducted.

At this time, there are cases where the cooling loads of the utilization units 3, 4 and 5 become extremely small. In such cases, it is necessary to reduce the refrigerant condensing ability in the heat source heat exchanger 23 of the heat source unit 2 and balance the overall cooling load of the utilization units 3, 4 and 5 (specifically, the evaporation loads of the utilization heat exchangers 32, 42 and 52). For this reason, control is conducted to reduce the condensation amount of the refrigerant in the heat source heat exchanger 23 by conducting control to reduce the opening of the heat source expansion valve 24. When control is conducted to reduce the opening of the heat source expansion valve 24, the amount of the liquid refrigerant accumulating inside the heat source heat exchanger 23 increases and the substantial heat transfer area is reduced, whereby the condensing ability becomes smaller. However, when control is conducted to reduce the opening of the heat source expansion valve 24, there is a tendency for the refrigerant pressure downstream of the heat source expansion valve 24 (specifically, between the heat source expansion valve 24 and the utilization refrigerant circuits 12*a*, 12*b* and 12*c*) to drop and become unstable, and there is a tendency for it to become difficult to stably conduct control to reduce the condensing ability of the heat source refrigerant circuit 12*d*.

However, in the air conditioner 1 of the present embodiment, the pressurizing circuit 111 is disposed which causes the high-pressure gas refrigerant compressed and discharged by the compression mechanism 21 to merge with the refrigerant whose pressure is reduced in the heat source expansion valve 24 and which is sent to the utilization refrigerant circuits 12*a*, 12*b* and 12*c*. Additionally, the control valve 111*b* of the pressurizing circuit 111 is configured to be opened during the cooling operating mode (i.e., when the first switch mechanism 22 is in the condensation operation switched state) such that it can cause the refrigerant to merge downstream of the heat source expansion valve 24 from the discharge side of the compression mechanism 21 through the pressurizing pipe 111*a*. For this reason, the pressure of the refrigerant downstream of the heat source expansion valve 24 can be raised by causing the high-pressure gas refrigerant to merge through the pressurizing circuit 111 downstream of the heat source expansion valve 24 while control is conducted to reduce the opening of the heat source expansion valve 24. However, when the high-pressure gas refrigerant is simply caused to merge downstream of the heat source expansion valve 24 through the pressurizing circuit 111, the high-pressure gas refrigerant merges and the refrigerant sent to the utilization refrigerant circuits 12*a*, 12*b* and 12*c* becomes a gas-liquid two-phase flow with a large gas fraction, and when the refrigerant is branched from the liquid refrigerant communication pipe 9 to the utilization refrigerant circuits 12*a*, 12*b* and 12*c*, drift arises between the utilization refrigerant circuits 12*a*, 12*b* and 12*c*.

However, in the air conditioner 1 of the present embodiment, the cooler 121 is disposed downstream of the heat source expansion valve 24. For this reason, control is conducted to raise the refrigerant pressure downstream of the heat source expansion valve 24 by causing the high-pressure gas refrigerant to merge through the pressurizing circuit 111 downstream of the heat source expansion valve 24 while control is conducted to reduce the opening of the heat source expansion valve 24, and the refrigerant whose pressure is reduced by the heat source expansion valve 24 and which is sent to the utilization refrigerant circuits 12*a*, 12*b* and 12*c* is cooled by the cooler 121. For this reason, the gas refrigerant can be condensed, and refrigerant of a gas-liquid two-phase flow with a large gas fraction does not have to be sent to the utilization refrigerant circuits 12*a*, 12*b* and 12*c*. Further, in the air conditioner 1 of the present embodiment, because the pressurizing pipe 111*a* is connected between the heat source expansion valve 24 and the receiver 25, the high-pressure gas refrigerant merges with the refrigerant downstream of the heat source expansion valve 24, and the refrigerant whose temperature has risen as a result of the high-pressure gas refrigerant merging therewith is cooled by the cooler 121. For this reason, it is not necessary to use a low-temperature cooling source as the cooling source for cooling the refrigerant in the cooler 121, and a cooling source with a relatively high temperature can be used. Moreover, in the air conditioner 1 of the present embodiment, the cooling circuit 122 is disposed, the pressure of some of the refrigerant sent from the heat source heat exchanger 23 to the utilization refrigerant circuits 12*a*, 12*b* and 12*c* is reduced to a refrigerant pressure that can return it to the intake side of the compression mechanism 21, and this refrigerant is used as the cooling source of the cooler 121. For this reason, a cooling source can be obtained which has a sufficiently lower temperature than the temperature of the refrigerant whose pressure is reduced in the heat source expansion valve 24 and which is sent to the utilization refrigerant circuits 12*a*, 12*b* and 12*c*. For this reason, the refrigerant whose pressure is reduced in the heat source expansion valve 24 and which is sent to the utilization refrigerant circuits 12*a*, 12*b* and 12*c* can be cooled to a subcooled state. Additionally, the opening of the cooling circuit expansion valve 122*b* of the cooling circuit 122 is regulated in accordance with the flow rate and temperature of the refrigerant sent to the utilization refrigerant circuits 12*a*, 12*b* and 12*c* from downstream of the heat source expansion valve 24, such as regulating the opening on the basis of the degree of superheat of the cooler 121 (calculated from the refrigerant temperature detected by the cooling circuit outlet temperature sensor 96 disposed in the lead-out pipe 122*c* of the cooling circuit 122).

<Simultaneous Cooling and Heating Operating Mode (Evaporation Load)>

Figure 7:
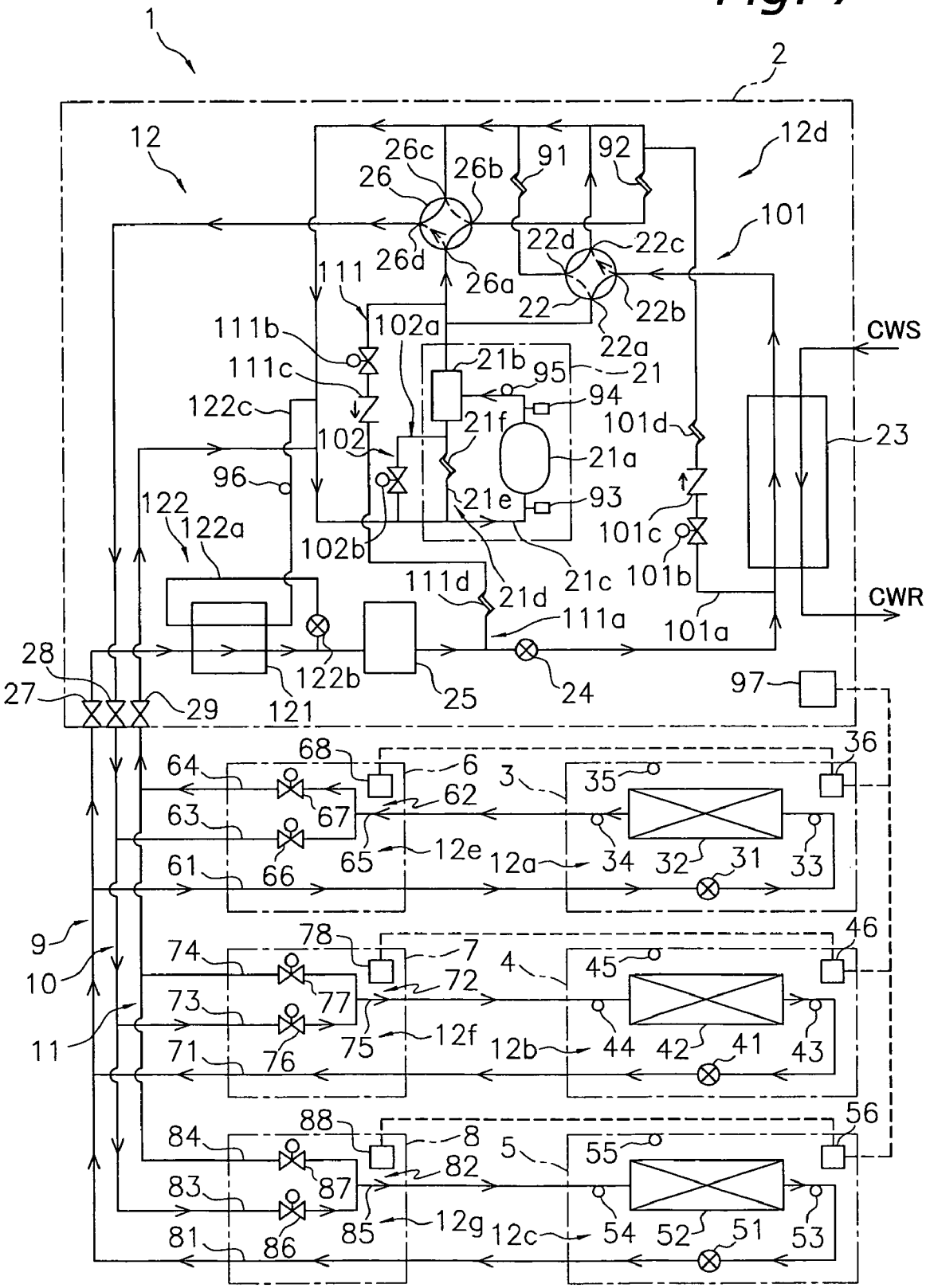
FIG. 7 A schematic diagram of the refrigerant circuit describing the operation during a simultaneous cooling and heating operating mode (evaporation load) of the air conditioner.

The operation will be described during the simultaneous cooling and heating operating mode where, for example, the utilization unit 3 of the utilization units 3, 4 and 5 conducts the cooling operation and the utilization units 4 and 5 conduct the heating operation, when the heat source heat exchanger 23 of the heat source unit 2 is caused to function and operate as an evaporator (evaporation operating switching mode). In this case, the refrigerant circuit 12 of the air conditioner 1 is configured as shown in FIG. 7 (refer to the arrows added to the refrigerant circuit 12 in FIG. 7 for the flow of the refrigerant). Specifically, in the heat source refrigerant circuit 12*d* of the heat source unit 2, similar to the aforementioned heating operating mode, the first switch mechanism 22 is switched to the evaporation operation switched state (the state indicated by the dotted lines of the first switch mechanism 22 in FIG. 7) and the second switch mechanism 26 is switched to the heating load requirement operating state (the state indicated by the dotted lines of the second switch mechanism 26 in FIG. 7), whereby the heat source heat exchanger 23 is caused to function as an evaporator so that the high-pressure gas refrigerant compressed and discharged in the compression mechanism 21 can be supplied to the utilization units 4 and 5 through the high-pressure gas refrigerant communication pipe 10. Further, the opening of the heat source expansion valve 24 is regulated to reduce the pressure of the refrigerant. It will be noted that the control valve 111*b* of the pressurizing circuit 111 and the cooling circuit expansion valve 122*b* of the cooling circuit 122 are closed so that the high-pressure gas refrigerant is not caused to merge with the refrigerant flowing between the heat source expansion valve 24 and the receiver 25 and the supply of the cooling source to the cooler 121 is cut off such that that the refrigerant flowing between the receiver 25 and the utilization units 3, 4 and 5 is not cooled. In the connection unit 6, the high-pressure gas control valve 66 is closed and the low-pressure gas control valve 67 is opened, whereby the utilization heat exchanger 32 of the utilization unit 3 is caused to function as an evaporator, and the utilization heat exchanger 32 of the utilization unit 3 and the intake side of the compression mechanism 21 of the heat source unit 2 become connected via the low-pressure gas refrigerant communication pipe 11 (i.e., the cooling operation switched state). In the utilization unit 3, the opening of the utilization expansion valve 31 is regulated in accordance with the cooling load of the utilization unit, such as the opening being regulated on the basis of the degree of superheat of the utilization heat exchanger 32 (specifically, the temperature difference between the refrigerant temperature detected by the liquid temperature sensor 33 and the refrigerant temperature detected by the gas temperature sensor 34), for example. In the connection units 7 and 8, the low-pressure gas control valves 77 and 87 are closed and the high-pressure gas control valves 76 and 86 are opened, whereby the utilization heat exchangers 42 and 52 of the utilization units 4 and 5 are caused to function as condensers (i.e., the heating operation switched state). In the utilization units 4 and 5, the openings of the utilization expansion valves 41 and 51 are regulated in accordance with the heating load of each utilization unit, such as the openings being regulated on the basis of the degree of subcooling of the utilization heat exchangers 42 and 52 (specifically, the temperature difference between the refrigerant temperature detected by the liquid temperature sensors 43 and 53 and the refrigerant temperature detected by the gas temperature sensors 44 and 54), for example.

In this configuration of the refrigerant circuit 12, a large portion of the refrigerating machine oil accompanying the high-pressure gas refrigerant that has been compressed and discharged by the compressor 21*a* of the compression mechanism 21 is separated in the oil separator 21*b* from this high-pressure gas refrigerant, and the high-pressure gas refrigerant is sent to the second switch mechanism 26. Then, the refrigerating machine oil separated in the oil separator 21*b* is returned to the intake side of the compressor 21*a* through the second oil returning circuit 21*d*. The high-pressure gas refrigerant sent to the second switch mechanism 26 is sent to the high-pressure gas refrigerant communication pipe 10 through the first port 26*a* and the fourth port 26*d* of the second switch mechanism 26 and the high-pressure gas closing valve 28.

Then, the high-pressure gas refrigerant sent to the high-pressure gas refrigerant communication pipe 10 is branched into two and sent to the high-pressure gas connection pipes 73 and 83 of the connection units 7 and 8. The high-pressure gas refrigerant sent to the high-pressure gas connection pipes 73 and 83 of the connection units 7 and 8 is sent to the utilization heat exchangers 42 and 52 of the utilization units 4 and 5 through the high-pressure gas control valves 76 and 86 and the junction gas connection pipes 75 and 85.

Then, the high-pressure gas refrigerant sent to the utilization heat exchangers 42 and 52 is condensed in the utilization heat exchangers 42 and 52 of the utilization units 4 and 5 as a result of heat exchange being conducted with the indoor air. The indoor air is heated and supplied to the indoors. The refrigerant condensed in the utilization heat exchangers 42 and 52 passes through the utilization expansion valves 41 and 51 and is thereafter sent to the liquid connection pipes 71 and 81 of the connection units 7 and 8.

Then, the refrigerant sent to the liquid connection pipes 71 and 81 is sent to the liquid refrigerant communication pipe 9 and merges.

Then, some of the refrigerant that has been sent to the liquid refrigerant communication pipe 9 and merged is sent to the liquid connection pipe 61 of the connection unit 6. Then, the refrigerant sent to the liquid connection pipe 61 of the utilization unit 6 is sent to the utilization expansion valve 31 of the utilization unit 3.

Then, the pressure of the refrigerant sent to the utilization expansion valve 31 is reduced by the utilization expansion valve 31, and the refrigerant is evaporated in the utilization heat exchanger 32 as a result of heat exchange being conducted with the indoor air and becomes low-pressure gas refrigerant. The indoor air is cooled and supplied to the indoors. Then, the low-pressure gas refrigerant is sent to the junction gas connection pipe 65 of the connection unit 6.

Then, the low-pressure gas refrigerant sent to the junction gas connection pipe 65 is sent to the low-pressure gas refrigerant communication pipe 11 through the low-pressure gas control valve 67 and the low-pressure gas connection pipe 64, and merges.

Then, the low-pressure gas refrigerant sent to the low-pressure gas refrigerant communication pipe 11 is returned to the intake side of the compression mechanism 21 through the low-pressure gas closing valve 29.

The remaining refrigerant excluding the refrigerant sent from the liquid refrigerant communication pipe 9 to the connection unit 6 and the utilization unit 3 is sent to the receiver 25 through the liquid closing valve 27 and the cooler 121 of the heat source unit 2. The refrigerant sent to the receiver 25 is temporarily accumulated inside the receiver 25, and the pressure of the refrigerant is thereafter reduced by the heat source expansion valve 24. Then, the refrigerant whose pressure has been reduced by the heat source expansion valve 24 is evaporated in the heat source heat exchanger 23 as a result of heat exchange being conducted with water serving as a heat source, becomes low-pressure gas refrigerant, and is sent to the first switch mechanism 22. Then, the low-pressure gas refrigerant sent to the first switch mechanism 22 is returned to the intake side of the compression mechanism 21 through the second port 22*b* and the third port 22*c* of the first switch mechanism 22. In this manner, the operation in the simultaneous cooling and heating operating mode (evaporation load) is conducted.

At this time, there are cases where, in accordance with the overall air conditioning load of the utilization units 3, 4 and 5, an evaporation load is necessary as the heat source heat exchanger 23 and the size thereof becomes extremely small. In such cases, similar to the aforementioned heating operating mode, it is necessary to reduce the refrigerant evaporating ability in the heat source heat exchanger 23 of the heat source unit 2 and balance the overall air conditioning load of the utilization units 3, 4 and 5. In particular, there are cases where the cooling load of the utilization unit 3 and the heating loads of the utilization units 4 and 5 become about the same in the simultaneous cooling and heating operating mode, and in such cases it becomes easier for the refrigerating machine oil to accumulate inside the heat source heat exchanger 23 than in the aforementioned heating operating mode because the evaporation load of the heat source heat exchanger 23 must be extremely reduced.

Figure 8:
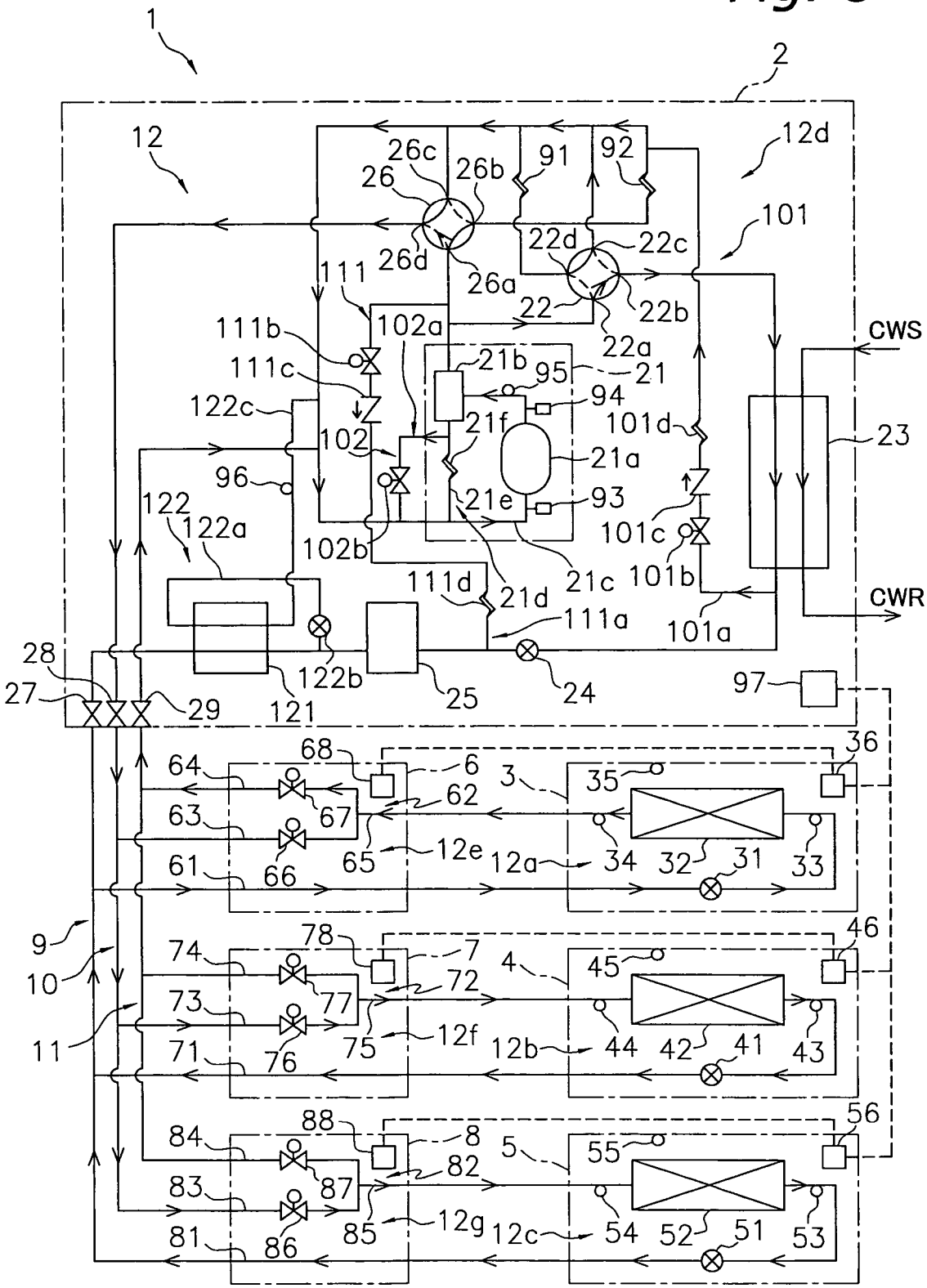
FIG. 8 A schematic diagram of the refrigerant circuit describing the operation of an oil recovery operation during the simultaneous cooling and heating operating mode (evaporation load) of the air conditioner.

However, in the air conditioner 1 of the present embodiment, the first oil returning circuit 101 and the first bypass circuit 102 are disposed. For this reason, similar to the aforementioned heating operating mode, when the first switch mechanism 22 is switched to and operates in the evaporation operation switching state, as shown in FIG. 8, the oil recovery operation is conducted by temporarily opening the control valve 102*b* so that the refrigerant discharged from the compression mechanism 21 is bypassed via the first bypass circuit 102 to the intake side of the compression mechanism 21, switching the first switch mechanism 22 to the condensation operation switched state (the state indicated by the solid lines of the first switch mechanism 22 in FIG. 8), and closing the heat source expansion valve 24 and opening the control valve 101*b*, and thereafter the air conditioner 1 is returned to the operating state shown in FIG. 7 prior to the oil recovery operation by closing the control valve 101*b*, opening the heat source expansion valve 24, and closing the control valve 102*b*.

To describe in detail this oil recovery operation and the operation of returning to the operating state prior to the oil recovery operation, first, when the control valve 102*b* of the first bypass circuit 102 is opened, some of the high-pressure gas refrigerant compressed and discharged by the compressor 21*a* of the compression mechanism 21 passes through the oil separator 21*b* and is sent to the first switch mechanism 22 and the second switch mechanism 26, and the remaining high-pressure gas refrigerant is sent from the oil separator 21*b* to the compression mechanism 21 through the first bypass circuit 102. Next, when the heat source expansion valve 24 is closed, the flow of the refrigerant from the utilization units 4 and 5 conducting the heating operation to the utilization unit 3 conducting the cooling operation via the connection units 6, 7 and 8 and the liquid refrigerant communication pipe 9 is secured, but the flow of the refrigerant returning to the heat source heat exchanger 23 through the liquid refrigerant communication pipe 9 is stopped. Next, when the control valve 101*b* of the first oil returning circuit 101 is opened after the first switch mechanism 22 is switched to the condensation operation switched state, the high-pressure gas refrigerant flows in from the upper side of the heat source heat exchanger 23 through the first switch mechanism 22 and flows toward the lower side, and the refrigerating machine oil accumulating inside the heat source heat exchanger 23 is swept to the intake side of the compression mechanism 21 through the first oil returning circuit 101 (see FIG. 8). Then, after the oil recovery operation ends, the air conditioner 1 returns to the operating state prior to the oil recovery operation by closing the control valve 101*b*, switching the first switch mechanism 22 to the evaporation operation switched state, opening the heat source expansion valve 24, and closing the control valve 102*b* (see FIG. 7). Here, the reason the refrigerant discharged from the compression mechanism 21 is bypassed to the intake side of the compression mechanism 21 via the first bypass circuit 102 during the oil recovery operation is to prevent liquid compression in the compression mechanism 21 by mixing the refrigerating machine oil returned to the intake side of the compression mechanism 21 through the first oil returning circuit 101 with the high-pressure gas refrigerant bypassed via the first bypass circuit 102. It will be noted that the order in which the control valves 101*b* and 102*b*, the heat source expansion valve 24 and the first switch mechanism 22 are opened and closed is not limited to the above, but from the standpoint of securing a flow path of the high-pressure gas refrigerant discharged from the compression mechanism 21, it is preferable to conduct the operation of opening the control valve 102*b* before other operations when conducting the oil recovery operation and to conduct the operation of closing the control valve 102*b* after other operations have been conducted when returning to the operating state prior to the oil recovery operation.

By conducting this oil recovery operation, the high-pressure gas control valves 66, 76 and 86 and the low-pressure gas control valves 67, 77 and 87 of the connection units 6, 7 and 8 serving as utilization switch mechanisms are switched to the cooling operation switched state despite the fact that the first switch mechanism 22 is temporarily switched to the condensation operation switched state, the start of returning to the operating state prior to the oil recovery operation after the oil recovery operation can be quickly conducted because the orientation of the flow of the refrigerant in the entire refrigerant circuit 12 does not have to be changed, the indoor comfort is not compromised, and the refrigerating machine oil accumulating inside the heat source heat exchanger 23 can be recovered in a short amount of time.

It will be noted that, similar to the aforementioned heating operating mode, the oil recovery operation may be periodically conducted when the first switch mechanism 22 is switched to and operates in the evaporation operation switched state, or in order to reduce the frequency of the oil recovery operation, may be periodically conducted just when the first switch mechanism 22 is switched to and operates in the evaporation operation switched state and where the level of the refrigerant inside the heat source heat exchanger 23 drops as a result of conducting control to reduce the opening of the heat source expansion valve 24 and it becomes difficult for the refrigerating machine oil to be discharged together with the evaporated refrigerant.

<Simultaneous Cooling and Heating Mode (Condensation Load)>

Figure 9:
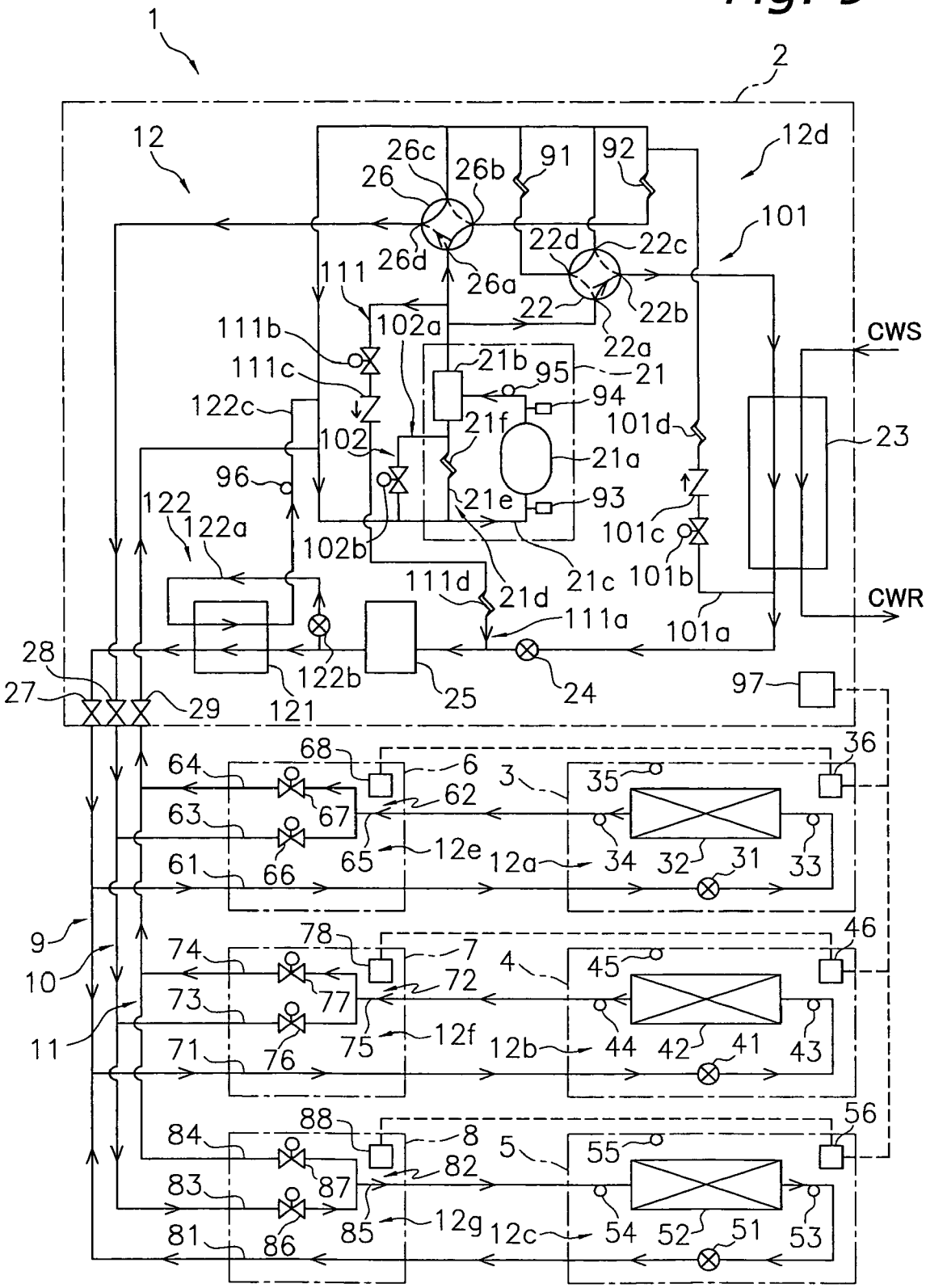
FIG. 9 A schematic diagram of the refrigerant circuit describing the operation during the simultaneous cooling and heating operating mode (condensation load) of the air conditioner.

The operation will be described during the simultaneous cooling and heating operating mode where, for example, the utilization units 3 and 4 of the utilization units 3, 4 and 5 conduct the cooling operation and the utilization unit 5 conducts the heating operation, when the heat source heat exchanger 23 of the heat source unit 2 is caused to function and operate as a condenser in accordance with the overall air conditioning load of the utilization units 3, 4 and 5 (condensation operating switching mode). In this case, the refrigerant circuit 12 of the air conditioner 1 is configured as shown in FIG. 9 (refer to the arrows added to the refrigerant circuit 12 in FIG. 9 for the flow of the refrigerant). Specifically, in the heat source refrigerant circuit 12*d* of the heat source unit 2, the first switch mechanism 22 is switched to the condensation operation switched state (the state indicated by the solid lines of the first switch mechanism 22 in FIG. 9) and the second switch mechanism 26 is switched to the heating load requirement operating state (the state indicated by the dotted lines of the second switch mechanism 26 in FIG. 9), whereby the heat source heat exchanger 23 is caused to function as an evaporator so that the high-pressure gas refrigerant compressed and discharged in the compression mechanism 21 can be supplied to the utilization unit 5 through the high-pressure gas refrigerant communication pipe 10. Further, the heat source expansion valve 24 is opened. It will be noted that the control valve 101*b* of the first oil returning circuit 101 and the control valve 102*b* of the first bypass circuit 102 are closed so that the oil recovery operation using these circuits is not conducted. In the connection units 6 and 7, the high-pressure gas control valves 66 and 76 are closed and the low-pressure gas control valves 67 and 77 are opened, whereby the utilization heat exchangers 32 and 42 of the utilization units 3 and 4 are caused to function as evaporators, and the utilization heat exchangers 32 and 42 of the utilization units 3 and 4 and the intake side of the compression mechanism 21 of the heat source unit 2 become connected via the low-pressure gas refrigerant communication pipe 11 (i.e., the cooling operation switched state). In the utilization units 3 and 4, the openings of the utilization expansion valves 31 and 41 are regulated in accordance with the cooling load of each utilization unit, such as the openings being regulated on the basis of the degree of superheat of the utilization heat exchangers 32 and 42 (specifically, the temperature difference between the refrigerant temperature detected by the liquid temperature sensors 33 and 43 and the refrigerant temperature detected by the gas temperature sensors 34 and 44), for example. In the connection unit 8, the low-pressure gas control valve 87 is closed and the high-pressure gas control valve 86 is opened, whereby the utilization heat exchanger 52 of the utilization unit 5 is caused to function as a condenser. In the utilization unit 5, the opening of the utilization expansion valve 51 is regulated in accordance with the heating load of the utilization unit, such as the opening being regulated on the basis of the degree of subcooling of the utilization heat exchanger 52 (specifically, the temperature difference between the refrigerant temperature detected by the liquid temperature sensor 53 and the refrigerant temperature detected by the gas temperature sensor 54), for example.

In this configuration of the refrigerant circuit 12, a large portion of the refrigerating machine oil accompanying the high-pressure gas refrigerant that has been compressed and discharged by the compressor 21*a* of the compression mechanism 21 is separated in the oil separator 21*b* from this high-pressure gas refrigerant, and the high-pressure gas refrigerant is sent to the first switch mechanism 22 and the second switch mechanism 26. Then, the refrigerating machine oil separated in the oil separator 21*b* is returned to the intake side of the compressor 21*a* through the second oil returning circuit 21*d*. Then, the high-pressure gas refrigerant sent to the first switch mechanism 22 of the high-pressure gas refrigerant that has been compressed and discharged by the compression mechanism 21 is sent to the heat source heat exchanger 23 through the first port 22*a* and the second port 22*b* of the first switch mechanism 22. Then, the high-pressure gas refrigerant sent to the heat source heat exchanger 23 is condensed in the heat source heat exchanger 23 as a result of heat exchange being conducted with water serving as a heat source. Then, the refrigerant condensed in the heat source heat exchanger 23 passes through the heat source expansion valve 24, the high-pressure gas refrigerant that has been compressed and discharged by the compression mechanism 21 merges therewith through the pressurizing circuit 111 (the details will be described later), and the refrigerant is sent to the receiver 25. Then, the refrigerant sent to the receiver 25 is temporarily accumulated inside the receiver 25 and sent to the cooler 121. Then, the refrigerant sent to the cooler 121 is cooled as a result of heat exchange being conducted with the refrigerant flowing through the cooling circuit 122 (the details will be described later). Then, the refrigerant cooled in the cooler 121 is sent to the liquid refrigerant communication pipe 9 through the liquid closing valve 27.

The high-pressure gas refrigerant sent to the second switch mechanism 26 of the high-pressure gas refrigerant that has been compressed and discharged by the compression mechanism 21 is sent to the high-pressure gas refrigerant communication pipe 10 through the first port 26*a* and the fourth port 26*d* of the second switch mechanism 26 and the high-pressure gas closing valve 28.

Then, the high-pressure gas refrigerant sent to the high-pressure gas refrigerant communication pipe 10 is sent to the high-pressure gas connection pipe 83 of the connection unit 8. The high-pressure gas refrigerant sent to the high-pressure gas connection pipe 83 of the connection unit 8 is sent to the utilization heat exchanger 52 of the utilization unit 5 through the high-pressure gas control valve 86 and the junction gas connection pipe 85.

Then, the high-pressure gas refrigerant sent to the utilization heat exchanger 52 is condensed in the utilization heat exchanger 52 of the utilization unit 5 as a result of heat exchange being conducted with the indoor air. The indoor air is heated and supplied to the indoors. The refrigerant condensed in the utilization heat exchanger 52 passes through the utilization expansion valve 51 and is thereafter sent to the liquid connection pipe 81 of the connection unit 8.

Then, the refrigerant sent to the liquid connection pipe 81 is sent to the liquid refrigerant communication pipe 9 and merges with the refrigerant sent to the liquid refrigerant communication pipe 9 through the first switch mechanism 22, the heat source heat exchanger 23, the heat source expansion valve 24, the receiver 25, the cooler 121 and the liquid closing valve 27.

Then, the refrigerant flowing through the liquid refrigerant communication pipe 9 is branched into two and sent to the liquid connection pipes 61 and 71 of the connection units 6 and 7. Then, the refrigerant sent to the liquid connection pipes 61 and 71 of the connection units 6 and 7 is sent to the utilization expansion valves 31 and 41 of the utilization units 3 and 4.

Then, the pressure of the refrigerant sent to the utilization expansion valves 31 and 41 is reduced by the utilization expansion valves 31 and 41, and the refrigerant is thereafter evaporated in the utilization heat exchangers 32 and 42 as a result of heat exchange being conducted with the indoor air and becomes low-pressure gas refrigerant. The indoor air is cooled and supplied to the indoors. Then, the low-pressure gas refrigerant is sent to the junction gas connection pipes 65 and 75 of the connection units 6 and 7.

Then, the low-pressure gas refrigerant sent to the junction gas connection pipes 65 and 75 is sent to the low-pressure gas refrigerant communication pipe 11 through the low-pressure gas control valves 67 and 77 and the low-pressure gas connection pipes 64 and 74, and merges.

Then, the low-pressure gas refrigerant sent to the low-pressure gas refrigerant communication pipe 11 is returned to the intake side of the compression mechanism 21 through the low-pressure gas closing valve 29. In this manner, the operation in the simultaneous cooling and heating operating mode (condensation load) is conducted.

At this time, there are cases where, in accordance with the overall air conditioning load of the utilization units 3, 4 and 5, a condensation load is necessary for the heat source heat exchanger 23 and the size thereof becomes extremely small. In such cases, similar to the aforementioned cooling operating mode, it is necessary to reduce the refrigerant condensing ability in the heat source heat exchanger 23 of the heat source unit 2 and balance the overall air conditioning load of the utilization units 3, 4 and 5. In particular, there are cases where the cooling loads of the utilization units 3 and 4 and the heating load of the utilization unit 5 become about the same in the simultaneous cooling and heating operating mode, and in such cases the condensation load of the heat source heat exchanger 23 must be made extremely small.

However, in the air conditioner 1 of the present embodiment, control is conducted to raise the pressure of the refrigerant downstream of the heat source expansion valve 24 by causing the high-pressure gas refrigerant to merge through the pressurizing circuit 111 downstream of the heat source expansion valve 24 while reducing the opening of the heat source expansion valve 24, and the refrigerant whose pressure is reduced by the heat source expansion valve 24 and which is sent to the utilization refrigerant circuits 12*a* and 12*b* is cooled by cooler 121. For this reason, the gas refrigerant can be condensed, and refrigerant of a gas-liquid two-phase flow with a large gas fraction does not have to be sent to the utilization refrigerant circuits 12*a* and 12*b*.

(3) Characteristics of the Air Conditioner

The air conditioner 1 of the present embodiment has the following characteristics.

(A) The air conditioner 1 of the present embodiment is disposed with the refrigerant circuit 12 that includes the heat source heat exchanger 23 configured such that refrigerant flows in from below and flows out from above when the heat source heat exchanger 23 functions as an evaporator of the refrigerant, with the refrigerant circuit 12 being capable of switching such that the heat source heat exchanger 23 and the utilization heat exchangers 32, 42 and 52 are caused by the first switch mechanism 22 serving as a heat source switch mechanism and the connection units 6, 7 and 8 (specifically, the high-pressure gas control valves 66, 76 and 86 and the low-pressure gas control valves 67, 77 and 87) serving as utilization switch mechanisms to function separately as evaporators or condensers of the refrigerant. For this reason, when the operation is conducted which causes the heat source heat exchanger 23 to function as an evaporator of the refrigerant as a result of the first switch mechanism 22 being switched to the evaporation operation switched state, the refrigerant discharged from the compression mechanism 21 passes through the high-pressure gas refrigerant pipe including the high-pressure gas refrigerant communication pipe 10, is sent to the utilization heat exchangers 32, 42 and 52 functioning as condensers of the refrigerant as a result of the connection units 6, 7 and 8 being switched to the heating operation switched state, is condensed, and is sent to the liquid refrigerant pipe including the liquid refrigerant communication pipe 9. Then, the refrigerant is evaporated in the heat source heat exchanger 23 after passing through the heat source expansion valve 24, and is taken into the compression mechanism 21. Here, the refrigerant flows inside the heat source heat exchanger 23 such that it flows in from below and flows out from above when the first switch mechanism 22 is switched to the evaporation operation switched state and operation is conducted. For this reason, when control is conducted to reduce the evaporating ability of the heat source heat exchanger 23 by reducing the opening of the heat source expansion valve 24 in accordance with the air conditioning load in the utilization heat exchangers 32, 42 and 52, the refrigerating machine oil accumulates inside the heat source heat exchanger 23.

However, because the air conditioner 1 is disposed with the first bypass circuit 102 and the first oil returning circuit 101, the oil recovery operation can be conducted where, when the first switch mechanism 22 is switched to and operates in the evaporation operation switched state, the refrigerant discharged from the compression mechanism 21 is bypassed to the intake side of the compression mechanism 21 via the first bypass circuit 102, the first switch mechanism 22 is switched to the condensation operation switched state, and the heat source expansion valve 24 is closed, whereby the refrigerant discharged from the compression mechanism 21 is caused to flow into the heat source heat exchanger 23, and the refrigerating machine oil accumulating inside the heat source heat exchanger 23 is returned to the intake side of the compression mechanism 21 via the first oil returning circuit 101. By conducting this oil recovery operation, the connection units 6, 7 and 8 are switched to the evaporation operation switched state and the orientation of the flow of the refrigerant in the entire refrigerant circuit 12 does not have to be changed despite the fact that the first switch mechanism 22 is switched to the condensation operation switched state, so that the start of returning to the operating state prior to the oil recovery operation after the oil recovery operation can be quickly conducted, the indoor comfort is not compromised, and the refrigerating machine oil accumulating inside the heat source heat exchanger can be recovered in a short amount of time.

In this manner, in the air conditioner 1, even when control is conducted to reduce the evaporating ability of the heat source heat exchanger 23 by reducing the opening of the heat source expansion valve 24 in accordance with the air conditioning load of the utilization heat exchangers 32, 42 and 52 so that as a result the level of the refrigerant inside the heat source heat exchanger 23 drops, the refrigerating machine oil does not accumulate inside the heat source heat exchanger 23. For this reason, the control width when the evaporating ability of the heat source heat exchanger 23 is controlled by the heat source expansion valve 24 can be expanded.

Additionally, in the air conditioner 1, it becomes unnecessary, unlike conventional air conditioners, to dispose plural heat source heat exchangers and conduct control to reduce the evaporating ability by closing some of the plural heat source expansion valves to reduce the number of heat source heat exchangers functioning as evaporators when the heat source heat exchangers are caused to function as evaporators or to reduce the evaporating ability by causing some of the heat source heat exchangers to function as condensers to offset the evaporating ability of the heat source heat exchangers functioning as evaporators. For this reason, a wide control width of the evaporating ability can be obtained by a single heat source heat exchanger.

Thus, because simplification of the heat source heat exchanger becomes possible in an air conditioner where simplification of the heat source heat exchangers could not be realized by restricting the control width of the control of the evaporating ability of the heat source heat exchangers, increases in the number of parts and cost that had occurred in conventional air conditioners as a result of disposing plural heat source heat exchangers can be prevented. Further, the problem of the COP becoming poor in an operating condition where, when some of plural heat source heat exchangers are caused to function as condensers to reduce the evaporating ability, the amount of refrigerant compressed in the compression mechanism increases in correspondence to the amount of refrigerant condensed by the heat source heat exchangers and the air conditioning load of the utilization refrigerant circuits is small can be eliminated.

(B) In the air conditioner 1 of the present embodiment, a plate heat exchanger where the numerous flow paths 23*b* are formed is used as the heat source heat exchanger 23, and it is difficult in terms of its structure to dispose, in each flow path 23*b* of the heat source heat exchanger 23, an oil returning circuit for extracting the refrigerating machine oil in order to prevent the refrigerating machine oil from accumulating inside the heat source heat exchanger 23. However, in the air conditioner 1, the refrigerating machine oil accumulating inside the heat source heat exchanger 23 can be extracted together with the refrigerant flowing in from the upper side of the heat source heat exchanger 23 such that the refrigerating machine oil is swept from the lower portion of the heat source heat exchanger. For this reason, it is easy to dispose the first oil returning circuit 101 even when a plate heat exchanger is used.

(C) In the air conditioner 1 of the present embodiment, when the pressure of the refrigerant condensed in the heat source heat exchanger 23 functioning as a condenser is reduced by the heat source expansion valve 24 and is sent to the utilization refrigerant circuits 12*a*, 12*b* and 12*c*, the pressure of the refrigerant is increased as a result of the high-pressure gas refrigerant merging therewith from the pressurizing circuit 111, and the refrigerant pressure downstream of the heat source expansion valve 24 rises. Here, when the high-pressure gas refrigerant is simply caused to merge as in conventional air conditioners, the refrigerant sent to the utilization refrigerant circuits 12*a*, 12*b* and 12*c* becomes a gas-liquid two-phase flow with a large gas fraction so that as a result the opening of the heat source expansion valve 24 cannot be sufficiently reduced. However, in the air conditioner 1, the refrigerant whose pressure is reduced by the heat source expansion valve 24 and which is sent to the utilization refrigerant circuits 12*a*, 12*b* and 12*c* is cooled by the cooler 121. For this reason, the gas refrigerant can be condensed, and refrigerant of a gas-liquid two-phase flow with a large gas fraction does not have to be sent to the utilization refrigerant circuits 12*a*, 12*b* and 12*c*.

Thus, in the air conditioner 1, even if control is conducted to reduce the condensing ability of the heat source heat exchanger 23 by reducing the opening of the heat source expansion valve 24 in accordance with the air conditioning load of the utilization refrigerant circuits 12*a*, 12*b* and 12*c* and control is conducted with the pressurizing circuit 111 to cause the high-pressure gas refrigerant merge and raise the pressure of the refrigerant, refrigerant of a gas-liquid two-phase flow with a large gas fraction does not have to be sent to the utilization refrigerant circuits 12*a*, 12*b* and 12*c*. For this reason, the control width when the evaporating ability of the heat source heat exchanger 23 is controlled by the heat source expansion valve 24 can be expanded.

Additionally, in the air conditioner 1, it becomes unnecessary, unlike conventional air conditioners, to dispose plural heat source heat exchangers and conduct control to reduce the evaporating ability by closing some of plural heat source expansion valves to reduce the number of heat source heat exchangers functioning as evaporators when the heat source heat exchangers are caused to function as condensers or to reduce the evaporating ability by causing some of the heat source heat exchangers to function as condensers to offset the evaporating ability of the heat source heat exchangers functioning as evaporators. For this reason, a wide control width of the condensing ability can be obtained by a single heat source heat exchanger.

Thus, because simplification of the heat source heat exchanger becomes possible in an air conditioner where simplification of the heat source heat exchangers could not be realized by restricting the control width of the control of the condensing ability of the heat source heat exchangers, increases in the number of parts and cost that had occurred in conventional air conditioners as a result of disposing plural heat source heat exchangers can be prevented. Further, the problem of the COP becoming poor in an operating condition where, when some of plural heat source heat exchangers are caused to function as evaporators to reduce the condensing ability, the amount of refrigerant compressed in the compression mechanism increases in correspondence to the amount of refrigerant condensed by the heat source heat exchangers and the air conditioning load of the utilization refrigerant circuits is small can be eliminated.

(D) In the air conditioner 1 of the present embodiment, because the pressurizing circuit 111 is connected between the heat source expansion valve 24 and the cooler 121 such that the high-pressure gas refrigerant merges, the refrigerant whose temperature has become higher as a result of the high-pressure gas refrigerant merging therewith becomes cooled by the cooler 121. Thus, it is not necessary to use a low-temperature cooling source as the cooling source for cooling the refrigerant in the cooler 121, and a cooling source with a relatively high temperature can be used.

Further, in the air conditioner 1, because refrigerant whose pressure is reduced to a refrigerant pressure that can return, to the intake side of the compression mechanism 21, some of the refrigerant sent from downstream of the heat source expansion valve 24 to the utilization refrigerant circuits 12*a*, 12*b* and 12*c* is used as the cooling source of the cooler 121, a cooling source with a sufficiently lower temperature than the temperature of the refrigerant sent from downstream of the heat source expansion valve 24 to the utilization refrigerant circuits 12*a*, 12*b* and 12*c* can be obtained. Thus, the refrigerant sent from downstream of the heat source expansion valve 24 to the utilization refrigerant circuits 12*a*, 12*b* and 12*c* can be cooled to a subcooled state.

(E) In the air conditioner 1 of the present embodiment, water, of which a constant amount is supplied without relation to the flow rate of the refrigerant flowing through the heat source heat exchanger 23, is used, and the evaporating ability in the heat source heat exchanger 23 cannot be controlled by controlling the water amount. However, in the air conditioner 1, because the control width when the evaporating ability of the heat source heat exchanger 23 is controlled by the heat source expansion valve 24 is expanded, the control width when controlling the evaporating ability of the heat source heat exchanger 23 can be ensured even if the water amount is not controlled.

(4) Modification 1

Figure 10:
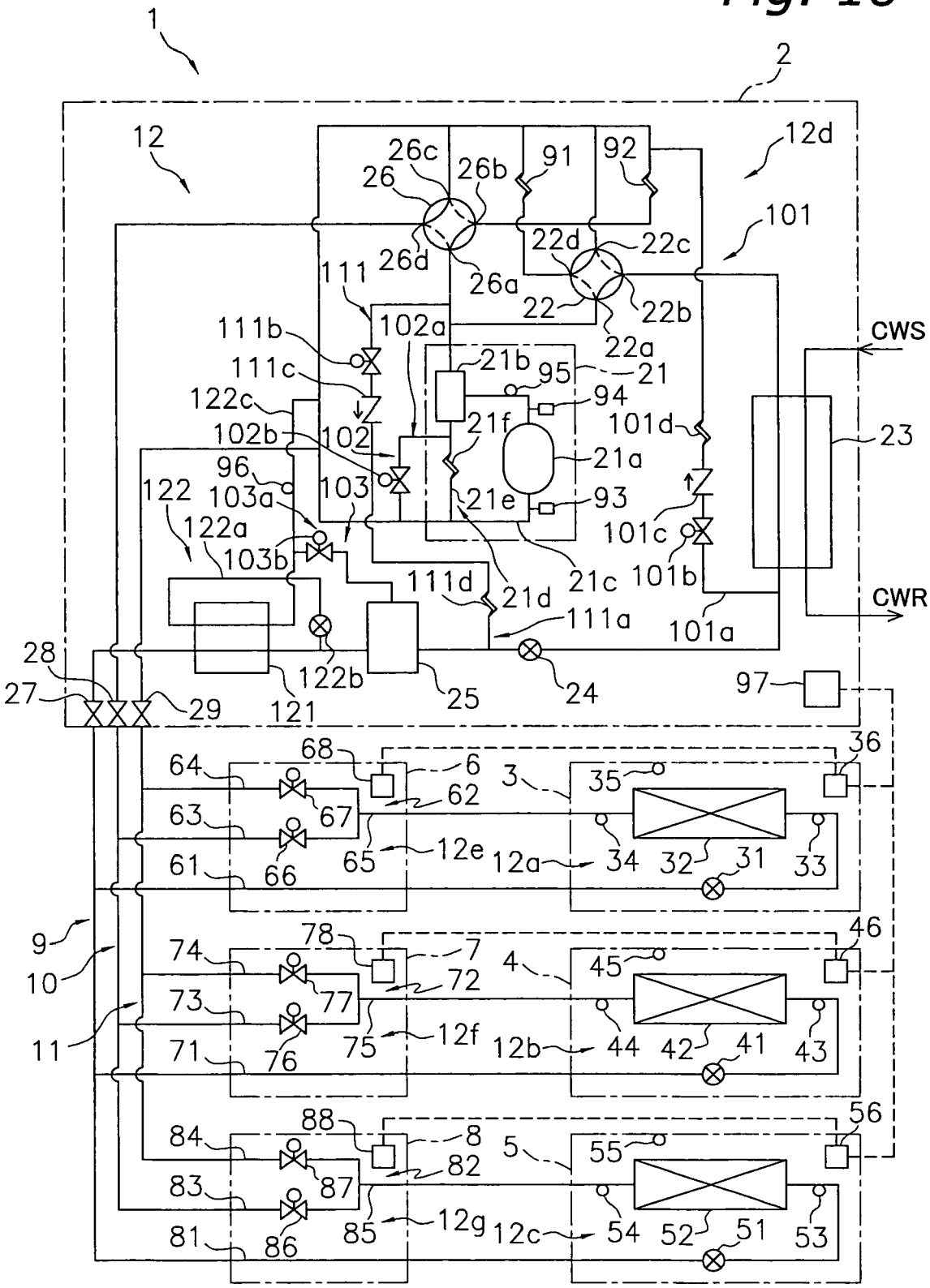
FIG. 10 A schematic diagram of a refrigerant circuit of an air conditioner pertaining to modification 1.

In the aforementioned air conditioner 1, the first oil returning circuit 101 and the first bypass circuit 102 are disposed in order to expand the control width of the control of the evaporating ability of the heat source heat exchanger 23 by the heat source expansion valve 24. However, as mentioned previously, because the heat source expansion valve 24 is closed during the oil recovery operation, the flow of the refrigerant from the liquid refrigerant communication pipe 9 to the heat source heat exchanger 23 stops, and the heating operation of the utilization unit conducting the heating operation of the utilization units 3, 4 and 5 stops (the utilization units 3, 4 and 5 in the heating operating mode; see FIG. 5) or the heating ability drops (the utilization units 4 and 5 in the simultaneous cooling and heating operating mode (evaporation load); see FIG. 8), even though it is a short period of time. For this reason, as shown in FIG. 10, the air conditioner 1 of the present embodiment is disposed with a second bypass circuit 103 that can branch the refrigerant from the liquid refrigerant pipe connecting the utilization heat exchangers 32, 42 and 52 and the heat source heat exchanger 23 and send the refrigerant to the intake side of the compression mechanism 21 (specifically, the lead-out pipe 122*c* of the cooling circuit 122 connected to the intake side of the compression mechanism 21). The second bypass circuit 103 mainly includes a bypass pipe 103, which connects the intake side of the compression mechanism 21 and a position of the liquid refrigerant pipe between the utilization heat exchangers 32, 42 and 52 and the heat source expansion valve 24, and a control valve 103*b* connected to the bypass pipe 103*a*. In the present embodiment, as shown in FIG. 10, the bypass pipe 103*a* is disposed such that the refrigerant is sent from the upper portion of the receiver 25 to the intake side of the compression mechanism 21. For this reason, when the control valve 103*b* is opened during the oil recovery operation, the gaseous refrigerant accumulating at the upper portion of the receiver 25 is preferentially sent to the intake side of the compression mechanism 21. It will be noted that because it suffices for the bypass pipe 103*a* to be able to send the refrigerant to the intake side of the compression mechanism 21 from the position of the liquid refrigerant pipe between the utilization heat exchangers 32, 42 and 52 and the heat source expansion valve 24, the bypass pipe 103*a* may also be directly connected to the liquid refrigerant pipe rather than the receiver 25, but in order to prevent as much as possible liquid refrigerant from being sent to the intake side of the compression mechanism 21, it is preferable to connect the bypass pipe 103*a* to the upper portion of the receiver 25 as in the present embodiment.

By disposing the second bypass circuit 103 in this manner, the refrigerant can be sent to the utilization heat exchangers of the utilization units conducting the heating operation even during the oil recovery operation, and the heating operation can be continued. Moreover, by disposing the second bypass circuit 103 such that the refrigerant is sent to the intake side of the compression mechanism 21 from the upper portion of the receiver 25 as in the present embodiment, the gaseous refrigerant is preferentially sent, and liquid refrigerant can be prevented from being sent, to the intake side of the compression mechanism 21.

(5) Modification 2

Figure 11:
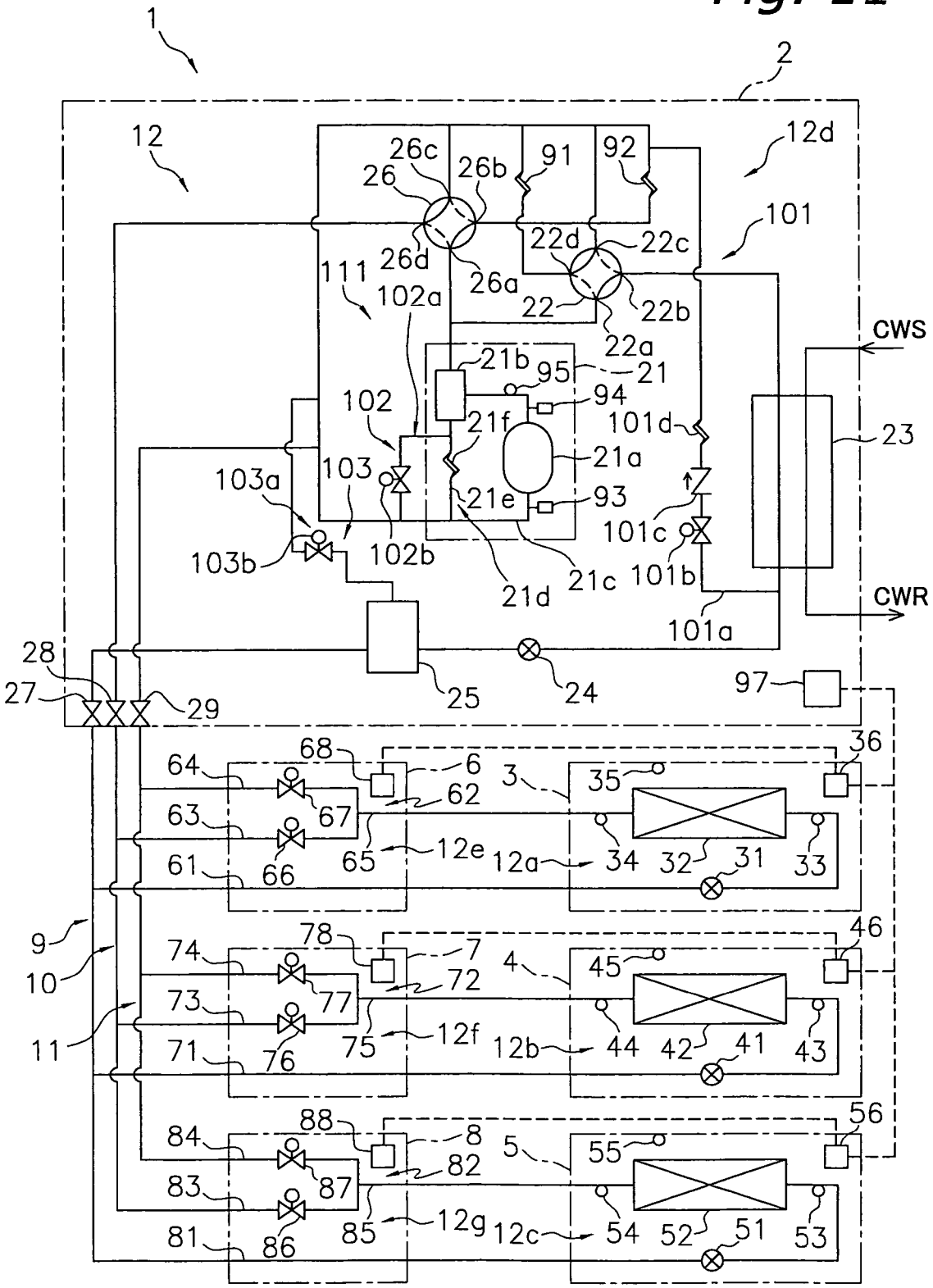
FIG. 11 A schematic diagram of a refrigerant circuit of an air conditioner pertaining to modification 2.

In the aforementioned air conditioner 1, the first oil returning circuit 101, the first bypass circuit 102, the pressurizing circuit 111, the cooler 121 and the cooling circuit 122 (further including the second bypass circuit 102 in the case of modification 1) are disposed in the heat source unit 2 in order to expand both the control width of the control of the evaporating ability of the heat source heat exchanger 23 by the heat source expansion valve 24 and the control width of the control of the condensing ability of the heat source heat exchanger 23 by the heat source expansion valve 24. However, when the control width of the control of the evaporating ability of the heat source heat exchanger 23 is ensured and it is necessary to expand only the control width of the control of the condensing ability of the heat source heat exchanger 23, for example, just the first oil returning circuit 101 and the first bypass circuit 102 (further including the second bypass circuit 103 in the case of modification 1) may be disposed in the heat source unit 2 as shown in FIG. 11, the pressuring circuit 111, the cooler 121, and the cooling circuit 102 may be omitted.

(6) Modification 3

Figure 12:
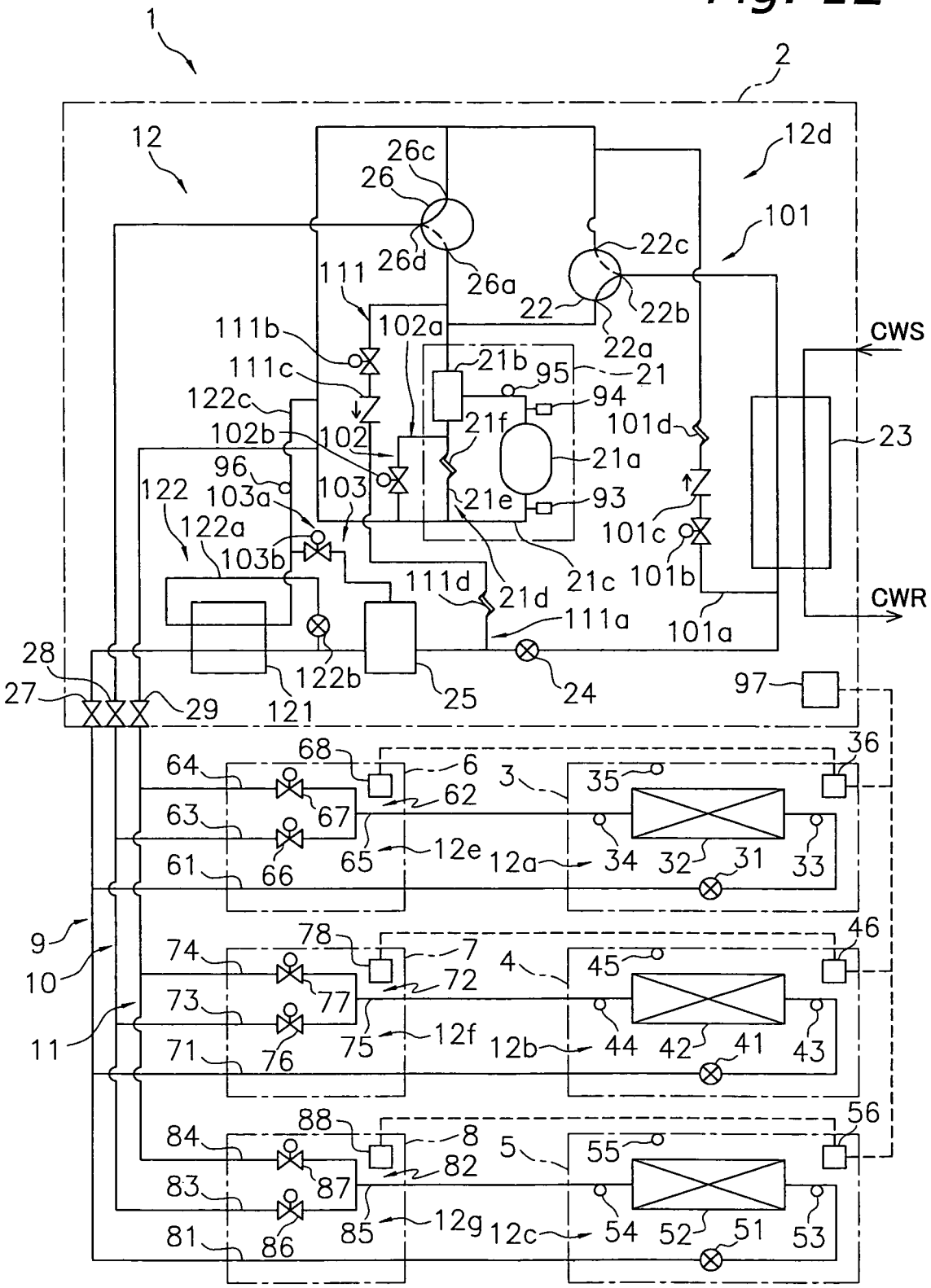
FIG. 12 A schematic diagram of a refrigerant circuit of an air conditioner pertaining to modification 3.

In the aforementioned air conditioner 1, four-way switch valves were used as the first switch mechanism 22 and the second switch mechanism 26, but the switch mechanisms are not limited thereto. For example, as shown in FIG. 12, three-way switch valves may also be used as the first switch mechanism 22 and the second switch mechanism 26.

INDUSTRIAL APPLICABILITY

By utilizing the present invention, the control width when the evaporating ability of a heat source heat exchanger is controlled by a heat source expansion valve can be expanded in an air conditioner disposed with a refrigerant circuit that includes a heat source heat exchanger configured such that refrigerant flows in from below and flows out from above when the heat source heat exchanger functions as an evaporator of the refrigerant, with the refrigerant circuit being capable of switching that causes the heat source heat exchanger and utilization heat exchangers to function separately as evaporators or condensers of the refrigerant.

What is claimed is:

1. An air conditioner comprising:

a refrigerant circuit including a compression mechanism, a heat source heat exchanger configured such that refrigerant enters the heat source heat exchanger at a position on a lower portion of the heat source heat exchanger, and leaves the heat source heat exchanger from a position on an upper portion of the heat source heat exchanger when the heat source heat exchanger functions as an evaporator of the refrigerant, a plurality of utilization heat exchangers, a liquid refrigerant pipe connecting the heat source heat exchanger and the utilization heat exchangers, and an expansion valve disposed in the liquid refrigerant pipe, the refrigerant circuit being configured to switch to cause the heat source heat exchanger and the utilization heat exchangers to function separately as evaporators or condensers of the refrigerant;

a first bypass circuit selectively conducting the refrigerant discharged from the compression mechanism to an intake side of the compression mechanism; and an oil returning circuit connecting the lower portion of the heat source heat exchanger and the intake side of the compression mechanism, the oil returning circuit being arranged in a unit with the heat source heat exchanger and compression mechanism separate from units having the plurality of utilization heat exchangers, the oil returning circuit being configured to return oil from the heat source heat exchanger to the compression mechanism within the unit, the refrigerant circuit, the first bypass circuit and the oil returning circuit being further operatively arranged with respect to one another such that when the heat source heat exchanger is caused to function as an evaporator an oil recovery operation is conducted by temporarily causing the refrigerant discharged from the compression mechanism to be bypassed to the intake side of the compression mechanism via the first bypass circuit, causing the heat source heat exchanger to function as a condenser, and closing the expansion valve, the refrigerant being discharged from the compression mechanism is caused to flow into the heat source heat exchanger, and refrigerating machine oil accumulating inside the heat source heat exchanger being returned to the intake side of the compression mechanism via the oil returning circuit.

2. The air conditioner of claim 1, further comprising a second bypass circuit connected between the utilization heat exchangers and the expansion valve, configured to branch the refrigerant from the liquid refrigerant pipe and send the refrigerant to the intake side of the compression mechanism, and disposed in the liquid refrigerant pipe.

3. The air conditioner of claim 2, further comprising a receiver connected between the utilization heat exchangers and the expansion valve that accumulates the refrigerant flowing through the liquid refrigerant pipe and disposed in the liquid refrigerant pipe, and the second bypass circuit being disposed so as to send the refrigerant from an upper portion of the receiver to the intake side of the compression mechanism.

4. The air conditioner of claim 3, wherein the heat source heat exchanger is configured to use, as a heat source, water supplied at a constant flow rate without relation to a control of a flow rate of the refrigerant flowing inside the heat source heat exchanger.

5. The air conditioner of claim 3, wherein the heat source heat exchanger includes a plate heat exchanger.

6. The air conditioner of claim 2, wherein the heat source heat exchanger is configured to use, as a heat source, water supplied at a constant flow rate without relation to a control of a flow rate of the refrigerant flowing inside the heat source heat exchanger.

7. The air conditioner of claim 2, wherein the heat source heat exchanger includes a plate heat exchanger.

8. The air conditioner of claim 1, wherein the heat source heat exchanger is configured to use, as a heat source, water supplied at a constant flow rate without relation to a control of a flow rate of the refrigerant flowing inside the heat source heat exchanger.

9. The air conditioner of claim 1, wherein the heat source heat exchanger includes a plate heat exchanger.

10. An air conditioner comprising:

a refrigerant circuit including a compression mechanism, a heat source heat exchanger configured such that refrigerant enters the heat source heat exchanger at a position on a lower portion of the heat source heat exchanger, and leaves the heat source heat exchanger from a position on an upper portion of the heat source heat exchanger when the heat source heat exchanger functions as an evaporator of the refrigerant, a plurality of utilization heat exchangers, a liquid refrigerant pipe connecting the heat source heat exchanger and the utilization heat exchangers, an expansion valve disposed in the liquid refrigerant pipe, a heat source switch mechanism configured to switch between a condensation operation switched state that causes the heat source heat exchanger to function as a condenser of the refrigerant discharged from the compression mechanism and an evaporation operation switched state that causes the heat source heat exchanger to function as an evaporator of the refrigerant flowing through the liquid refrigerant pipe, a high-pressure gas refrigerant pipe connected between an intake side of the compression mechanism and the heat source switch mechanism and configured to branch the refrigerant discharged from the compression mechanism before the refrigerant flows into the heat source switch mechanism, a plurality of utilization switch mechanisms configured to switch between a cooling operation switched state that causes the heat source heat exchanger to function as an evaporator of the refrigerant flowing through the liquid refrigerant pipe and a heating operation switched state that causes the heat source heat exchanger to function as a condenser of the refrigerant flowing through the high-pressure gas refrigerant pipe, and a low-pressure gas refrigerant pipe that sends the refrigerant evaporated in the utilization heat exchangers to the intake side of the compression mechanism;

a first bypass circuit selectively conducting the refrigerant discharged from the compression mechanism to the intake side of the compression mechanism; and an oil returning circuit connecting the lower portion of the heat source heat exchanger and the intake side of the compression mechanism, the oil returning circuit being arranged in a unit with the heat source heat exchanger and compression mechanism separate from units having the plurality of utilization heat exchangers, the oil returning circuit being configured to return oil from the heat source heat exchanger to the compression mechanism within the unit, the refrigerant circuit, the first bypass circuit and the oil returning circuit being further operatively arranged with respect to one another such that when the heat source switch mechanism is switched to the evaporation operation switched state, an oil recovery operation is conducted by temporarily causing the refrigerant discharged from the compression mechanism to be bypassed to the intake side of the compression mechanism via the first bypass circuit, switching the heat source switch mechanism to the condensation operation switched state, and closing the expansion valve, the refrigerant being discharged from the compression mechanism is caused to flow into the heat source heat exchanger, and refrigerating machine oil accumulating inside the heat source heat exchanger being returned to the intake side of the compression mechanism via the oil returning circuit.

11. The air conditioner of claim 10, further comprising a second bypass circuit connected between the utilization heat exchangers and the expansion valve, configured to branch the refrigerant from the liquid refrigerant pipe and send the refrigerant to the intake side of the compression mechanism, and disposed in the liquid refrigerant pipe.

12. The air conditioner of claim 11, further comprising a receiver connected between the utilization heat exchangers and the expansion valve that accumulates the refrigerant flowing through the liquid refrigerant pipe and disposed in the liquid refrigerant pipe, and the second bypass circuit being disposed so as to send the refrigerant from an upper portion of the receiver to the intake side of the compression mechanism.

13. The air conditioner of claim 12, wherein the heat source heat exchanger is configured to use, as a heat source, water supplied at a constant flow rate without relation to a control of a flow rate of the refrigerant flowing inside the heat source heat exchanger.

14. The air conditioner of claim 12, wherein the heat source heat exchanger includes a plate heat exchanger.

15. The air conditioner of claim 11, wherein the heat source heat exchanger is configured to use, as a heat source, water supplied at a constant flow rate without relation to a control of a flow rate of the refrigerant flowing inside the heat source heat exchanger.

16. The air conditioner of claim 11, wherein the heat source heat exchanger includes a plate heat exchanger.

17. The air conditioner of claim 10, wherein the heat source heat exchanger is configured to use, as a heat source, water supplied at a constant flow rate without relation to a control of a flow rate of the refrigerant flowing inside the heat source heat exchanger.

18. The air conditioner of claim 10, wherein the heat source heat exchanger includes a plate heat exchanger.

19. An air conditioner comprising:

a refrigerant circuit including a compression mechanism, a heat source heat exchanger configured such that refrigerant enters the heat source heat exchanger at a position on a lower portion of the heat source heat exchanger, and leaves the heat source heat exchanger from a position on an upper portion of the heat source heat exchanger when the heat source heat exchanger functions as an evaporator of the refrigerant, and a plurality of utilization heat exchangers, the refrigerant circuit being configured to switch to cause the heat source heat exchanger and the utilization heat exchangers to function separately as evaporators or condensers of the refrigerant; and an oil returning circuit that connects the lower portion of the heat source heat exchanger and an intake side of the compression mechanism, the oil returning circuit being arranged in a unit with the heat source heat exchanger and compression mechanism separate from units having the plurality of utilization heat exchangers, the oil returning circuit being configured to return oil from the heat source heat exchanger to the compression mechanism within the unit, the refrigerant circuit and the oil returning circuit being further operatively arranged with respect to each other such that when the heat source heat exchanger is caused to function as an evaporator, an oil recovery operation is conducted by temporarily causing the heat source heat exchanger to function as a condenser, the refrigerant being discharged from the compression mechanism is caused to flow into the heat source heat exchanger, and refrigerating machine oil accumulating inside the heat source heat exchanger is returned to the intake side of the compression mechanism via the oil returning circuit.

20. The air conditioner of claim 19, further comprising a first bypass circuit selectively bypassing the refrigerant discharged from the compression mechanism to an intake side of the compression mechanism, the refrigerant discharged from the compression mechanism being bypassed to the intake side of the compression mechanism via the first bypass circuit during the oil recovery operation.

* * * * *